US005925508A

United States Patent [19]

Araki

[11] Patent Number: 5,925,508

[45] Date of Patent: Jul. 20, 1999

[54] METHOD FOR PRODUCING SILVER HALIDE PHOTOGRAPHIC EMULSION

[75] Inventor: Yasushi Araki, Minami-ashigara, Japan

[73] Assignee: Fuji Photo Film, Ltd., Kanagawa, Japan

[21] Appl. No.: 08/733,565

[22] Filed: Oct. 18, 1996

[30] Foreign Application Priority Data

Oct. 18, 1995 [JP] Japan ..... 7-293767

[51] Int. Cl.[6] ..... G03C 1/005; G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 4,797,354 | 1/1989 | Saitou et al. | 430/567 |
| 5,202,226 | 4/1993 | Saitou | 430/569 |
| 5,219,720 | 6/1993 | Black et al. | 430/567 |
| 5,223,388 | 6/1993 | Saitou | 430/569 |
| 5,254,454 | 10/1993 | Mimiya et al. | 430/569 |
| 5,334,495 | 8/1994 | Black et al. | 430/567 |

OTHER PUBLICATIONS

Science and Technology of Photography, Ed. Karlheinz Keller, VCH, New York, pp. 51–53, 1993.

*Primary Examiner*—Mark F. Huff

*Attorney, Agent, or Firm*—Birch, Stewart, Kolasch & Birch, LLP

[57] ABSTRACT

A method for producing a silver halide photographic emulsion is described, which emulsion comprises tabular grains of silver bromide or silver iodobromide having {111} faces as major faces parallel to each other, wherein an aqueous solution of silver salt or an aqueous solution of silver salt and an aqueous solution of halide is/are added at least one time within the period of time after the first nucleation and before Ostwald ripening progresses.

16 Claims, 2 Drawing Sheets

METHOD FOR PRODUCING SILVER HALIDE PHOTOGRAPHIC EMULSION

FIELD OF THE INVENTION

The present invention relates to a method for producing a tabular silver halide photographic emulsion which is useful in a field of photography.

BACKGROUND OF THE INVENTION

Silver halide grains which have two or more twin planes parallel to each other within one grain and take tabular shapes (hereinafter referred to as "tabular grains") are endowed with various advantageous photographic characteristics.

Further, in general, silver halide grains which are used in photographic materials are desirably produced only in a uniform grain shape and grain size. This is because if grains having different shapes are mixed or grain size distribution is broadened (narrow grain size distribution is hereinafter referred to as "high in monodispersibility"), there generate drawbacks such that all the grains cannot be optimally sensitized when the grains are subjected to chemical sensitization or spectral sensitization, or an interlayer effect cannot be put to practical use. With respect to production methods of tabular grains, various technical discussions have been done to improve these drawbacks. Examples thereof are disclosed in, for example, JP-A-63-151618 (the term "JP-A" as used herein means an "unexamined published Japanese patent application" ), JP-A-63-11928, JP-A-2-28638, JP-A-1-131541, JP-A-2-838, JP-A-2-298935, JP-A-3-121445, U.S. Pat. Nos. 4,439,520 and 4,433,048.

Conventional production methods for obtaining tabular grains comprise nucleation, Ostwald ripening and grain growing processes.

Nucleation is a process for generating a new silver halide crystal nucleus (hereinafter merely referred to as "a nucleus") by supplying an aqueous solution of silver salt and an aqueous solution of halide in the presence of a substance capable of becoming a protective colloid such as gelatin.

It is ideal that only the nuclei having parallel twin planes (hereinafter referred to as "tabular nuclei") are formed during the nucleus generating process, but as it is not possible, grains other than tabular nuclei have to be vanished in Ostwald ripening process (hereinafter referred to as "ripening"). Thereafter, tabular grains are grown to obtain the objective grains by again supplying a solution of water-soluble silver salt and a solution of water-soluble halide in the grain growing process.

For example, the formation of monodisperse tabular grains by forming nuclei under the conditions of the temperature and pBr of low solubility in the nucleation process is discussed in recent years.

As is disclosed in JP-W-5-500122 (corresponding to U.S. Pat. No. 4,797,354) (the term "JP-W" as used herein means an "unexamined published International patent application based on a Japanese patent application"), they succeeded in the formation of monodisperse tabular grains having narrow distance between twin planes by setting pBr to reach low solubility of silver halide and forming nuclei using oxidized gelatin.

However, according to conventional production methods, as ripening is carried out immediately after nucleation for forming monodisperse tabular grains, a considerable number of tabular nuclei formed in the nucleation process are dissolved during ripening. Accordingly, the absolute number of tabular grains is lessened and the size of the tabular grain obtained after ripening becomes large.

From the above, it has been difficult to produce tabular grains of a small size and high monodispersibility by conventional techniques.

A method for producing tabular grains which has conventionally been discussed so far to resolve this problem is described below.

JP-A-63-151618 (corresponding to U.S. Pat. Nos. 5,219,720 and 5,334,495) discloses a method of selectively growing tabular grains in low supersaturation in certain concentration of gelatin and pBr value in the latter stage of the ripening process.

However, according to the above method, the first nucleation is conducted at pBr value in the range of from 1.0 to 1.3. After ripening, the pBr is adjusted to a higher condition by the addition of an aqueous solution of silver nitrate and ripening is further progressed. On the contrary, the method of the present invention comprises adding an aqueous solution of silver salt or an aqueous solution of halide within the period of time before ripening progresses after the first nucleation, therefore, the method of the present invention is substantially different from the above method.

SUMMARY OF THE INVENTION

An object of the present invention is to provide a method for producing a silver halide emulsion by which tabular grains of a small size and high monodispersibility can be obtained.

The above object of the present invention has been attained by the methods (1) to (4) described below.

(1) A method for producing a silver halide photographic emulsion comprising tabular grains of silver bromide or silver iodobromide having {111} faces as major faces parallel to each other, wherein an aqueous solution of silver salt or an aqueous solution of silver salt and an aqueous solution of halide is/are added at least one time within the period of time after the first nucleation and before Ostwald ripening progresses.

(2) The method for producing a silver halide photographic emulsion as described in (1), wherein the pBr at the time of the addition of said aqueous solution of silver salt or said aqueous solution of silver salt and said aqueous solution of halide is different from the pBr at the time of the first nucleation.

(3) The method for producing a silver halide photographic emulsion as described in (2), wherein the pBr at the time of the addition of said aqueous solution of silver salt or said aqueous solution of silver salt and said aqueous solution of halide is lower than the pBr at the time of the first nucleation.

(4) The method for producing a silver halide photographic emulsion as described in (1), (2) or (3), wherein the nucleus is grown by the addition of said aqueous solution of silver salt or said aqueous solution of silver salt and said aqueous solution of halide.

DETAILED DESCRIPTION OF THE INVENTION

Figure 1:
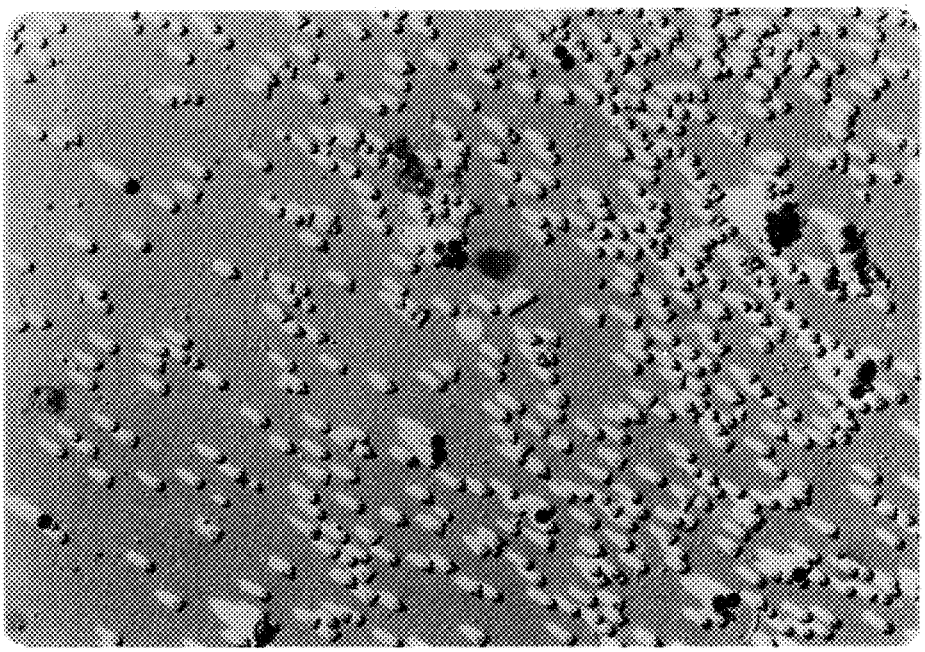
FIG. 1 is a photograph of a structure of grains after nucleation and nuclei are grown in high supersaturation at the utmost possible limit in which new nuclei are not generated while maintaining the pBr at 2.4 (magnification: 5,000-fold).

The present invention will be described in detail below.

The nucleation according to the present invention is a process to generate new silver halide crystal nuclei (hereinafter referred to as "nuclei") by supplying an aqueous solution of silver salt and an aqueous solution of halide at the same time or either one of them to a reaction vessel filled with an aqueous solution in which a substance capable of becoming a protective colloid such as gelatin is present.

An aqueous solution of silver salt used herein is preferably an aqueous solution of silver nitrate and an aqueous solution of halide is preferably an aqueous solution of potassium bromide or an aqueous solution of sodium bromide. Also, potassium iodide or sodium iodide may be contained in the solution.

Since the nucleation is conducted in one reaction vessel, two processes inevitably progress at the same time. One process is generating new nuclei (hereinafter referred to as "a nucleus generating process"). The other process is growing already generated nuclei (hereinafter referred to as "a nucleus growing process").

The first nucleation is described in detail below.

For generating nuclei of high monodispersibility, the time of the nucleation is preferably as short as possible. This is because, when the above-described nucleus growing process progresses at the same time, the longer the time of the nucleation, the larger are the differences of the sizes between the nuclei generated in the early stage and the nuclei generated in the latter stage. While when the time of the nucleation is short, the number of the nuclei generated becomes small. The well balanced time have to be set for producing tabular grains of a small size and high monodispersibility.

The addition time of the first nucleation is preferably from 10 seconds to 5 minutes, more preferably from 10 seconds to 3 minutes, and most preferably from 15 seconds to 1 minute and 30 seconds.

One method, in the nucleation process, to form monodisperse nuclei having parallel twin planes (hereinafter referred to as "tabular nuclei") as many as possible is that the reaction is carried out under the conditions in which the solubility is as low as possible. There are disclosed in I. H. Leubner, R. Jagannathan, and J. S. Wey, *Formation of Silver Bromide Crystals in Double-Jet Precipitation, Phot. Sci. Eng.*, 24, 268–272 (1980) that the total number of the nuclei generated increases as the solubility and the temperature are lowered and that ripening does not progress so much under the condition of low solubility and monodisperse nuclei are formed. That is, the first nucleation is preferably conducted under the condition of low solubility.

As such conditions, the temperature is preferably from 5° C. to 75° C., more preferably from 5° C. to 50° C., and most preferably from 5° C. to 40° C.

The pBr is preferably from 1.5 to less than 5.0, more preferably from 1.5 to less than 4.0, and still more preferably from 1.5 to 3.5, and most preferably from 2.0 to 3.5.

The pH is preferably from 1.0 to 9.0, more preferably from 1.0 to 7.0, still more preferably from 1.0 to 5.0, and most preferably from 1.0 to 4.0.

Another method to generate tabular nuclei as many as possible in the first nucleation process is, as disclosed in JP-A-2-146033, to well adjust the probability of the tabular nucleus generation. The probability of the generation of tabular nuclei having parallel twin planes is closely related with the probability of the generation of twin crystals. The probability of the generation of twin crystals is adjusted so as not to be too low but not too high. This is because if it is too high, multiple twin grains having many twin planes which are not parallel to each other are generated and such grains are hardly soluble, accordingly they remain after ripening. There are factors which control the probability of the generation of twin crystals as follows.

Any kind of gelatin can be used as protective colloid but low molecular weight gelatin having a molecular weight of from 5,000 to 20,000, oxidized gelatin and phthalated gelatin are more preferably used as gelatin.

The preferred concentration of gelatin varies according to the kind of gelatin, pBr and temperature but is preferably from 0 to 20%, more preferably from 0 to 15%, and most preferably from 0.1 to 10%.

Gelatin may be dissolved in the above-described reaction vessel or may be previously dissolved in the aqueous solution of silver salt or the aqueous solution of halide to be added or both of them.

The feed rate of the aqueous solution of silver salt or the aqueous solution of halide to be added differs variously according to the kind of gelatin contained in the reaction vessel, concentration, pBr and temperature but is preferably from 0.0002 to 0.05 mol/min. and more preferably from 0.0003 to 0.03 mol/min. per liter of the reaction vessel.

The silver amount to be added is preferably from 0.0003 to 0.04 mol and more preferably from 0.0003 to 0.03 mol per liter of the reaction vessel.

The aqueous solution of halide to be added may be a mixture of an aqueous solution of iodide and an aqueous solution of bromide or each may be added independently. Further, the molar fraction thereof of an aqueous solution of iodide to an aqueous solution of bromide is preferably from 0 to 0.3, more preferably from 0 to 0.2, and most preferably from 0 to 0.1. Similarly, the aqueous solution may be a mixture of an aqueous solution of chloride and an aqueous solution of bromide. Further, the molar fraction thereof of an aqueous solution of chloride to an aqueous solution of bromide is preferably from 0 to 0.5, more preferably from 0 to 0.4, still more preferably from 0 to 0.3, and most preferably from 0 to 0.2.

The concentration of the inorganic ion which can be added, such as a nitric acid ion, a potassium ion, a calcium ion or a barium ion, is in some cases preferably higher.

The size of the nucleus formed is in general very small just after the first nucleation and is liable to dissolve. Thereafter as ripening progresses, a part of the tabular nuclei formed in the first nucleation also dissolve with nontabular nuclei. Accordingly, by adding a solution of water-soluble silver salt or a solution of water-soluble halide with a solution of water-soluble silver salt after the termination of the first nucleation and before Ostwald ripening progresses, the tabular nuclei originally to dissolve can remain.

Details after the termination of the first nucleation are described below.

The time from the termination of the first nucleation until the next addition is the time in which Ostwald ripening does not progress. It is presumed that Ostwald ripening is progressing in a micro scale in any state. Therefore, "the time in which Ostwald ripening does not progress" used herein means the time in which the average grain size of the silver halide grains does not change 100% or more when sampling the silver halide emulsion before and after thereof, more preferably 50% or more, still more preferably 20% or more, and most preferably 10% or more.

Although the time depends upon the temperature and pBr at that time, it is preferably as short as possible, preferably from 0 second to 5 minutes, more preferably from 0 second to 2 minutes, and most preferably from 0 second to 1 minute.

As described above, when nuclei are grown after the first nucleation and before ripening progresses, tabular nuclei originally to dissolve can remain. It is preferred for tabular nuclei to grow faster than nontabular nuclei at that time.

Figure 2:
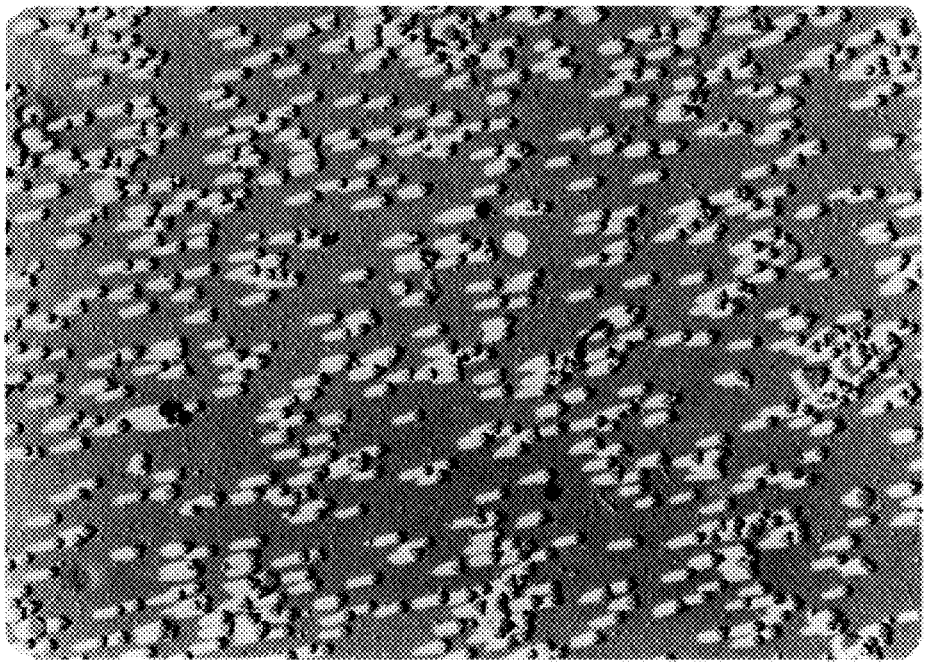
FIG. 2 is a photograph of a structure of grains after nucleation and nuclei are grown in high supersaturation at the utmost possible limit in which new nuclei are not generated while maintaining the pBr at 1.9 (magnification: 5,000-fold).
Figure 3:
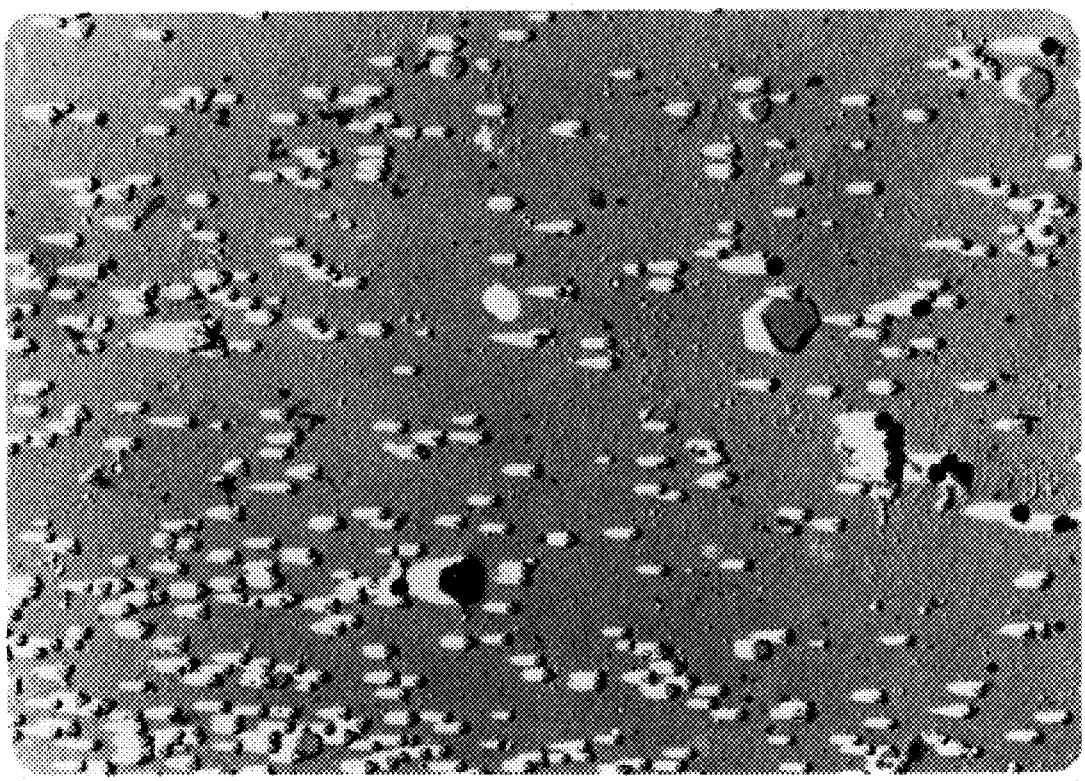
FIG. 3 is a photograph of a structure of grains after nucleation and nuclei are grown in high supersaturation at the utmost possible limit in which new nuclei are not generated while maintaining the pBr at 1.4 (magnification: 5,000-fold).

The lower the pBr condition under which grains are grown, the faster is the growth of tabular grains compared with nontabular grains. For example, in an aqueous solution of 40° C. and concentration of gelatin of 0.7% at pBr 2.5 or more, there is almost no difference between the growths of tabular grains and nontabular grains. While when pBr is 2.5 or less, tabular grains grow faster than nontabular grains, and the smaller the pBr, the bigger is the difference. FIG. 1, FIG. 2 and FIG. 3 each is a photograph of grains of the same nuclei grown in high supersaturation at the utmost possible limit in which new nuclei are not generated under the condition of pBr of 2.4, 1.9 and 1.4, respectively, and viewed the image of replica of the grains with an electron microscope.

The tabular grains in these electron microphotographs are hexagonal. It can be seen from these photographs that the smaller the pBr, the larger is the volume of the tabular grains. On the contrary, the volumes of the triangular grains and the octahedral grains are much the same. That is, it can be understood that only the tabular grains are grown conspicuously fast.

That is to say, the pBr of the time when adding an aqueous solution of silver salt alone or with an aqueous solution of halide after the termination of the first nucleation and before ripening progresses (hereinafter referred to as "the addition on and after the second") is preferably at least the pBr of the first nucleation or less, more preferably from 5.0 to 1.0, still more preferably from 4.0 to 1.0, and most preferably from 3.5 to 1.5.

The feed rate of the solution(s) on and after the second may be essentially any rate, that is, the addition may be conducted at an extremely high rate such that a nucleus growing process in which nuclei are growing and a nucleus generating process in which new nuclei are generated occur at the same time. However, if the feed rate is too slow, a ripening process comes out predominant, therefore, is not preferred.

Specifically, for the purpose of starting a nucleus generating process at the same time, the feed rate is preferably from 0.01 to 0.2 mol/min. per liter of the reaction vessel and for the purpose of growing already generated nuclei skillfully, it is preferably from 0.0003 to 0.02 mol/min. per liter of the reaction vessel.

In either case, the feeding flow rate is preferably accelerated.

It has been thought hitherto that nucleation must be finished in a short period of time for forming nuclei of high monodispersibility and generating new nuclei thereafter is not desired. This is because the nuclei formed in the early stage are grown during a nucleus growing process and become larger than the nuclei formed in the latter stage. There is disclosed in the above I. H. Leubner, R. Jagannathan, and J. S. Wey, *Formation of Silver Bromide Crystals in Double-Jet Precipitation, Phot. Sci. Eng.*, 24, 268–272 (1980) that the size of the nuclei to generate becomes larger when the solubility increases. Nuclei of high monodispersibility can be formed by controlling the pBr and increasing the solubility to make the size of the nuclei to generate in the latter stage large.

The new nucleus generation is preferably conducted under the following conditions. The pBr at this time is extremely preferably at least the pBr of the first nucleation or less, more preferably from 3.0 to 1.0, still more preferably from 2.5 to 1.0, and most preferably from 2.0 to 1.5.

If the silver amount to be added at the second time is too large, grains other than tabular nuclei are also grown. When the size of a grain becomes large, the solubility thereof becomes exponentially small, in general. Accordingly, it is not preferred to increase the addition amount of silver for the purpose of dissolving nontabular nuclei during ripening. That is, the addition amount of silver at the second time must be set such that the amount is not so large as nontabular nuclei are grown too large but not so small as tabular nuclei are not grown.

Specifically, the amount is preferably from 0.1 to 10 times, more preferably from 0.2 to 6 times, and most preferably from 0.5 to 3 times, based on the mol number of the silver added at the first nucleation process.

The aqueous solution of halide to be added may be a mixture of an aqueous solution of iodide and an aqueous solution of bromide as in the first nucleation. Similarly, the aqueous solution may be a mixture of an aqueous solution of chloride and an aqueous solution of bromide.

The temperature is preferably within ±10° C. or less of the temperature of the first nucleation process.

The above-described second addition of an aqueous solution of silver salt can be made as the addition on and after the third by modifying the conditions.

A ripening process is described in detail below.

After the termination of the second addition, nontabular nuclei other than tabular nuclei are dissolved during a ripening process. For dissolving nontabular nuclei while growing tabular nuclei, pBr is preferably low. However, too low a pBr makes the size distribution of the remaining tabular grain unfavorable, therefore, it must be adjusted properly. Specifically, although pBr depends on the temperature, it is preferably from 1.0 to 3.5, more preferably from 1.5 to 3.0, and most preferably from 1.5 to 2.0.

Further, a ripening process may be divided into two or more stages with pBr at the early stage being low while pBr at the latter being high.

During a ripening process, an aqueous solution of silver salt may be added alone or in combination with an aqueous solution of halide again one or more time for preventing the dissolution of tabular nuclei.

When the temperature of ripening is too high, ripening progresses fast and the probability of dissolution of tabular nuclei with nontabular nuclei becomes high. While when the temperature is too low, the time of ripening becomes very long. Accordingly, the temperature is set between these two points. Specifically, the temperature is preferably from 5 to 80° C., more preferably from 10 to 60° C., and most preferably from 20 to 50° C.

A substance capable of becoming a protective colloid such as gelatin, a substance capable of heightening progress of ripening by interaction with silver halide such as ammonia, or a substance which controls ripening by interaction and adsorption with and onto silver halide may be added during a ripening process.

A growing process of tabular grains after ripening is described in detail below.

A ripening process is terminated at the time when the number of tabular grains to the total number of nuclei reached from 80% to 100% in a ripening process. Thereafter, an aqueous solution of silver salt and an aqueous solution of halide are again added to grow tabular grains to thereby obtain the objective grain size. With respect to this growing process, it is desired to suppress the ripening to progress in parallel as far as possible.

The feed rate of the aqueous solution of silver salt and the aqueous solution of halide is a rate of the utmost possible limit in which new nuclei are not generated and the feeding is preferably conducted under high supersaturation conditions as far as possible. Specific feed rate varies largely according to temperature, pBr and concentration of gelatin, therefore, variously differs depending on the conditions thereof.

The pBr during the growing process depends upon the thickness of the objective silver halide grains. When the tabular grains are grown under a lower pBr condition, the thickness of the tabular grains obtained is thinner but the size distribution becomes unfavorable. On the contrary, when the tabular grains are grown under a higher pBr condition, the thickness of the tabular grains obtained is thicker but the size distribution becomes favorable. When they are grown, however, under the condition of pBr $\geqq 5.0$, {111} faces which constitute the major faces of the tabular grains become unstable and the grains are grown to maintain the shapes in which {100} faces are present more stably, therefore, not preferred. That is, the pBr condition is set according to the thickness of the objective tabular grains.

Further, a growing process may be divided into two or more stages with varying pBr in each stage.

Moreover, an adsorbent such as PAO (polyalkylene oxide) polymer which is adsorbed onto silver halide grains may be included in any process from the first nucleation, water washing and precipitation.

A defoaming agent may be included in any process from the first nucleation, water washing and precipitation.

The silver halide emulsion grains formed according to the method of the present invention (hereinafter referred to as "emulsion grains of the present invention") are described below.

Tabular grains of silver iodobromide or silver bromide having {111} faces as major faces parallel to each other are preferred as the emulsion grains of the present invention. Herein, tabular grains comprise major faces having parallel facing {111} faces and side faces joining with the major faces. The side faces may comprise {111} faces, {100} faces, mixtures of these two, or may comprise high index faces.

At least one twin plane is present between the major faces having {111} faces and, in general, two twin planes are observed. The distance between these two twin planes can be made less than 0.012 $\mu$m as disclosed in U.S. Pat. No. 5,219,720 and, further, as disclosed in JP-A-5-249585, the value obtained by dividing the distance between the major faces having {111} faces by the distance between the twin planes can also be made to 15 or more. The emulsion grains of the present invention comprise the tabular grains having an aspect ratio of 2 or more accounting for 50% or more, preferably 60% or more, and more preferably 70% or more, of the entire projected area. A projected area and an aspect ratio of tabular grains can be measured from an electron microphotograph by a carbon replica method shadowed together with latex ball for reference. A tabular grain when viewed from the above, in general, is in a hexagonal, triangular or circular shape. An aspect ratio is defined as the value obtained by dividing the diameter of the circle of the area corresponding to a projected area by the thickness of a grain. A proportion of a hexagonal tabular grains to the number of the entire grains is preferably increased as high as possible and, further, a ratio of adjacent side lengths of a hexagon is preferably from ½ to 2.

The variation coefficient of the grain size distribution is preferably 20% or less, particularly preferably 15% or less. The emulsion grains of the present invention comprise silver iodobromide grains or silver bromide grains. The emulsion grains of the present invention may contain silver chloride but the content is preferably 8 mol % or less, more preferably 3 mol % or less or 0 mol %. The content of silver iodide is preferably from 0 mol % to 20 mol %, and particularly preferably from 2 mol % to 15 mol %. The variation coefficient of the distribution of the silver iodide content among grains is preferably 20% or less, and particularly preferably 10% or less.

The emulsion grains of the present invention preferably have dislocation lines. The dislocation lines of tabular grains can be observed directly with the transmission type electron microscope at low temperature as disclosed, for example, in J. F. Hamilton, *Phot. Sci. Eng.*, 11, 57 (1967) and T. Shiozawa, *J. Soc. Phot. Sci. Japan*, 35, 213 (1972). That is, the silver halide grains taken out from the emulsion with a care so as not to apply such a pressure as generates dislocation lines on the grains are put on a mesh for observation by an electron microscope, and observation is conducted by a transmission method with the sample being in a frozen state so as to prevent the injury by an electron beam (e.g., printout). At this time, the thicker the thickness of the grain, the more difficult is the electron beam to be transmitted. Accordingly, it is preferred to use a high pressure type electron microscope (200 kV or more with the grains of the thickness of 0.25 $\mu$m) for observing clearly.

When viewed from the vertical direction to the major face of the grain by the photograph of the grains obtained as described above, the place and the number of dislocation lines with respect to each grain can be obtained.

The number of dislocation lines is preferably 10 or more per one grain on an average, more preferably 20 or more. In the case where dislocation lines exist densely or when dislocation lines are observed mingling with each other, the number of dislocation lines sometimes cannot be counted rightly. However, even in such a case, it is feasible to count roughly such as about 10, about 20, about 30, and can be clearly distinguished from the case where there are only several. The average number of dislocation lines per one grain is obtained as the number average by counting the number of dislocation lines of 100 grains or more.

Dislocation lines can be introduced, for example, in the vicinity of the periphery of a tabular grain. In this case, dislocation lines are almost vertical to the periphery. Dislocation line originates from the position of x% of the length of the distance from the center to the periphery of a tabular grain and lead to the periphery. This x value is preferably 10 or more and less than 100, more preferably 30 or more and less than 99, and most preferably 50 or more and less than 98. At this time, the shape formed by linking these positions where dislocation lines originate is near the like figure of the shape of a grain but not the complete like figure and is sometimes distorted. These types of dislocation lines cannot be seen in the central region of a grain. The directions of these dislocation lines are about {211} directions crystallographically, but they are sometimes snaking or mingling with each other.

A tabular grain may have dislocation lines on the entire periphery almost uniformly, or may have dislocation lines locally on the periphery. That is, taking a hexagonal tabular silver halide grain as an example, dislocation lines may be limited to be introduced only in the vicinity of six vertexes, or may be limited to only the vicinity of one vertex. On the contrary, it is possible to limit the introduction of dislocation lines only to the sides exclusive of the vicinity of six vertexes.

Further, dislocation lines may be formed over the region inclusive of the center part of two major faces parallel to each other of a tabular grain. When dislocation lines are formed over the entire region of the major faces, when viewed from the vertical direction to the major face of the grain, the directions of these dislocation lines are sometimes about {211} directions crystallographically, but there are other cases such as in which the directions of dislocation lines are {110} directions or formed at random. Further, the length of each dislocation line is also variously different and there are a case where dislocation lines are observed on the major face as short lines and a case where dislocation lines are observed as long lines arriving to the side (periphery). Dislocation lines are sometimes straight lines and sometimes snaking. Further, in many cases, they are mingling with each other.

As described above, positions of dislocation lines may be limited to the periphery, major faces or local positions, or may be formed in combinations of these. That is, they may be present on the periphery and major faces at the same time.

Gelatin is preferably used as a protective colloid at the time of preparation of the emulsion grains of the present invention and as a binder for other hydrophilic colloid layers, but other hydrophilic colloids can also be used.

Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, and starch derivatives; and various kinds of hydrophilic synthetic high polymers of homopolymers or copolymers such as polyvinyl alcohol, partially acetalated polyvinyl alcohol, poly-N-vinyl pyrrolidone, polyacrylic acid, polymethacrylic acid, polyacrylamide, polyvinylimidazole, and polyvinylpyrazole.

Acid-processed gelatin and enzyme-processed gelatin disclosed in *Bull. Soc. Sci. Photo. Japan*, No. 16, p. 30 (1966) can be used as well as lime-processed gelatin, and hydrolyzed product and enzyme decomposed product of gelatin can also be used.

The emulsion grains of the present invention are preferably washed with water for the purpose of desalting and dispersed in a newly prepared protective colloid. The washing temperature can be selected according to the purpose but is preferably from 5 to 50° C. The pH at washing time can also be selected according to the purpose but is preferably from 2 to 10, more preferably from 3 to 8. The pAg at washing time can also be selected according to the purpose but is preferably from 5 to 10. The washing method can be selected from among a noodle washing method, a dialysis method using a semi-permeable membrane, a centrifugal separation method, a coagulation precipitation method, and an ion exchange method. In the case of a coagulation precipitation method, a washing method can be selected from among a method using sulfate, a method using an organic solvent, a method using a water-soluble polymer, a method using a gelatin derivative, etc.

When the emulsion grains of the present invention is dispersed in a newly prepared protective colloid after water washing, it is preferred to add salt of $Zn^{2+}$, complex salt of Ir(III), or complex salt of Ir(IV), for example, $Zn(NO_3)_2$, $K_2IrCl_6$ and $K_3IrCl_6$ can be cited as representative examples of such a compound.

The emulsion grains of the present invention is preferably reduction sensitized during grain formation.

The method of the reduction sensitization can be selected from a method in which a reduction sensitizer is added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization.

Stannous salt, ascorbic acid and derivatives thereof, amines and polyamines, hydrazine derivatives, formamidine-sulfinic acid, silane compounds and borane compounds are well known as a reduction sensitizer. These known reduction sensitizers can be selected and used in the present invention, and two or more of these compounds can also be used in combination.

Further, the alkynylamine compound disclosed in U.S. Pat. No. 5,389,510 is preferably used.

Stannous chloride, thiourea dioxide, dimethylamine-borane, ascorbic acid and derivatives thereof are preferred compounds as a reduction sensitizer. As the addition amount of the reduction sensitizer depends upon the production conditions of the emulsion, the addition amount needs to be selected, but $10^{-7}$ to $10^{-3}$ Mol per mol of the silver halide is preferred.

The reduction sensitizers are dissolved in water or a solvent such as alcohols, glycols, ketones, esters or amides and added. The reduction sensitizers have been previously added to an aqueous solution of water-soluble silver salt or an aqueous solution of water-soluble alkali halide and silver halide grains can be precipitated using these aqueous solutions. In addition, the solution of the reduction sensitizers may be divided to several parts and added in several times or may be added continuously over a long period of time with the degree of the grain growth.

It is preferred to use an oxidizing agent for silver during the production process of the emulsion grains of the present invention. An oxidizing agent for silver is a compound having a function of acting on metal silver and converting it to a silver ion. In particular, a compound which can convert superminute silver grains by-produced in the course of the formation of silver halide grains and chemical sensitization to a silver ion is effective. The silver ion converted may form hardly water-soluble silver salt such as silver halide, silver sulfide or silver selenide, or may form easily water-soluble silver salt such as silver nitrate. An oxidant for silver may be inorganic or organic. Examples of inorganic oxidizing agents include oxyacid salt, such as ozone, hydrogen peroxide and addition products thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxyacid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), permanganate (e.g., $KMnO_4$), and chromate (e.g., $K_2Cr_2O_7$), halogen element such as iodine and bromine, perhalogen acid salt (e.g., potassium periodate), salt of metal of high valency (e.g., potassium hexacyanoferrate(III)), and thiosulfonate.

Further, examples of organic oxidizing agents include quinones such as p-quinone, organic peroxide such as peracetic acid and perbenzoic acid, a compound which releases active halogen (e.g., N-bromosuccinimide, chloramine T, chloramine B).

The oxidizing agents which are preferably used in the present invention are inorganic oxidizing agents such as ozone, hydrogen peroxide and addition products thereof, halogen element, thiosulfonate, and organic oxidizing agents such as quinones. It is preferred to use the above described reduction sensitization in combination with an oxidizing agent for silver. The disulfide compounds disclosed in U.S. Pat. No. 5,364,754 and EP-A-627657 are also preferably used. The method of usage can be selected from a method in which an oxidizing agent is used and then reduction sensitization is carried out, an inverse method thereof, or a method in which both are concurred with.

The emulsion grains of the present invention can be subjected to at least one of sulfur sensitization, selenium sensitization, gold sensitization, palladium sensitization, noble metal sensitization and reduction sensitization during chemical sensitization of silver halide emulsion. A combined use of two or more sensitizing methods is preferred. Various types of emulsions can be prepared depending upon the stages when the chemical sensitization is carried out. There are a type in which a chemically sensitized speck is buried in the internal part of a grain, a type in which a chemically sensitized speck is buried in the shallow part from the surface of a grain, or a type in which a chemically sensitized speck is formed on the surface of a grain. The emulsion grains of the present invention can select the place of a chemically sensitized speck according to the purpose, but it is generally preferred to have at least one chemically sensitized speck in the vicinity of the surface of a grain.

Chemical sensitizing methods which can be preferably conducted in the present invention are chalcogenide sensitization and noble metal sensitization alone or in combination, and these sensitizing methods can be carried out using active gelatin as disclosed in T. H. James, *The Theory of the Photographic Process*, 4th Ed., Macmillan, 1977, pp. 67 to 76, and also sensitization can be conducted using sulfur, selenium, tellurium, gold, platinum, palladium, or iridium, or two or more of these sensitizers in combination at pAg of from 5 to 10, pH of from 5 to 8, and temperature of from 30 to 80° C. as disclosed in *Research Disclosure*, Vol. 120, April, 1974, 12008, idib., Vol. 34, June, 1975, 13452, U.S. Pat. Nos. 2,642,361, 3,297,446, 3,772,031, 3,857,711, 3,901,714, 4,266,018 and 3,904,415 and British Patent 1,315,755. In noble metal sensitization, a noble metal salt such as gold, platinum, palladium and iridium can be used, and particularly preferred are gold sensitization, palladium sensitization, and the combined use of them. In gold sensitization, known compounds such as chloroauric acid, potassium chloroaurate, potassium aurithiocyanate, gold sulfide and gold selenide can be used. The palladium compound means 2-equivalent or 4-equivalent salt of palladium. Preferred palladium compound is represented by $R_2PdX_6$ or $R_2PdX_4$, wherein R represents a hydrogen atom, an alkali metal atom or an ammonium group; and X represents a halogen atom, e.g., chlorine, bromine or iodine.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. A gold compound and a palladium compound are preferably used in combination with thiocyanate or selenocyanate.

Hypo, thiourea based compounds, rhodanine based compounds, and the sulfur-containing compounds disclosed in U.S. Pat. Nos. 3,857,711, 4,266,018 and 4,054,457 can be used as sulfur sensitizers. The emulsion grains of the present invention are preferably sensitized by a selenium sensitizing method. Known unstable selenium compounds are used in selenium sensitization, and specific examples thereof include selenium compounds such as colloidal metal selenium, selenoureas (e.g., N,N-dimethylselenourea, N,N-diethylselenourea), seleno ketones and selenoamides. Chemical sensitization can be conducted in the presence of a so-called auxiliary chemical sensitizer. The compounds known to inhibit fogging during chemical sensitization and to increase sensitivity such as azaindene, azapyridazine, azapyrimidine, are used as a useful auxiliary chemical sensitizer. Examples of auxiliary chemical sensitizer reformer are disclosed in U.S. Pat. Nos. 2,131,038, 3,411,914, 3,554,757, JP-A-58-126526 and above described G. F. Duffin, *Photographic Emulsion Chemistry*, pp. 138 to 143.

The emulsion grains of the present invention is preferably spectrally sensitized with methine dyes and the like. The dyes which are used include a cyanine dye, a merocyanine dye, a complex cyanine dye, a complex merocyanine dye, a holopolar cyanine dye, a-hemicyanine dye, a styryl dye, and a hemioxonol dye. Particularly useful dyes are dyes belonging to a cyanine dye, a merocyanine dye and a complex merocyanine dye. Nuclei which are usually utilized as basic heterocyclic nuclei in cyanine dyes can be applied to these dyes. For example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; the above nuclei to which alicyclic hydrocarbon rings are fused; the above nuclei to which aromatic hydrocarbon rings are fused, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These heterocyclic nuclei may be substituted on the carbon atoms.

As a nucleus having a ketomethylene structure, a 5-or 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus, or a thiobarbituric acid nucleus can be applied to a merocyanine dye or a complex merocyanine dye.

These sensitizing dyes may be used alone or in combination. A combination of sensitizing dyes is often used for the purpose of supersensitization. Examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, JP-B-43-4936 (the term "JP-B" as used herein means an "examined Japanese patent publication"), JP-B-53-12375, JP-A-52-110618 and JP-A-52-109925.

Further, dyes which themselves do not have a spectral sensitizing function or substances which substantially do not absorb visible light but show supersensitization can be incorporated into the emulsion with sensitizing dyes.

Sensitizing dyes may be added to the emulsion at any stage of the preparation of the emulsion hitherto known to be useful. In general, it is conducted during the period after the completion of chemical sensitization and before coating, however, a method in which sensitizing dyes are added at the same time with the addition of chemical sensitizers and spectral sensitization is carried out simultaneously with chemical sensitization can be employable as disclosed in U.S. Pat. Nos. 3,628,969 and 4,225,666, further, as disclosed in JP-A-58-113928, spectral sensitization can be conducted prior to chemical sensitization, or sensitizing dyes can be added and spectral sensitization can be started before completion of the precipitation formation of the silver halide grains. Still further, as disclosed in U.S. Pat. No. 4,225,666, sensitizing dyes can be divided and added separately, that is, a part of them is added prior to chemical sensitization and the remaining is added after chemical sensitization, therefore, any time during silver halide grain formation is feasible, as well as the method disclosed in U.S. Pat. No. 4,183,756.

A sensitizing dye can be added in an amount of from $4\times10^{-6}$ to $8\times10^{-3}$ mol per mol of the silver halide, but in the case of more preferred silver halide grain size of from 0.2 to 1.2 $\mu$m, the amount of from $5\times10^{-5}$ to $2\times10^{-3}$ mol per mol of the silver halide is more preferred.

The emulsion of the present invention, and techniques such as layer arrangement, silver halide emulsion, functional couplers such as dye-forming couplers and DIR couplers, various additives and the like and development processing which can be used in the photographic material using the emulsion of the present invention are disclosed in EP-A-565096 (disclosed on Oct. 13th, 1993) and the patents cited therein. Each item and corresponding locations are listed below.

| | |
|---|---|
| 1. Layer Structures | lines 23 to 35, page 61, line 41, page 61 to line 14, page 62 |
| 2. Interlayers | lines 36 to 40, page 61 |
| 3. Interlayer Effect Donating Layers | lines 15 to 18, page 62 |
| 4. Halide Compositions of Silver Halide | lines 21 to 25, page 62 |
| 5. Crystal Habits of Silver Halide Grains | lines 26 to 30, page 62 |
| 6. Grain Sizes of Silver Halide Grains | lines 31 to 34, page 62 |
| 7. Production Methods of Emulsions | lines 35 to 40, page 62 |
| 8. Grain Size Distributions of Silver Halide Grains | lines 41–42, page 62 |
| 9. Tabular Grains | lines 43 to 46, page 62 |
| 10. Structures of Interiors of Grains | lines 47 to 53, page 62 |
| 11. Latent Image Forming Types of Emulsions | line 54, page 62 to line 5, page 63 |
| 12. Physical Ripening and Chemical Ripening of Emulsions | lines 6 to 9, page 63 |
| 13. Mixed Usage of Emulsions | lines 10 to 13, page 63 |
| 14. Fogged Emulsions | lines 14 to 31, page 63 |
| 15. Light-Insensitive Emulsions | lines 32 to 43, page 63 |
| 16. Coating Amount of Silver | lines 49 and 59, page 63 |
| 17. Photographic Additives | disclosed in Research Disclosure, Item 17643 (Dec., 1978), ibid., Item 18716 (Nov., 1979) and ibid., Item 307105 (Nov., 1989) and the locations related thereto are indicated below |

-continued

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Antifoggants and Stabilizers | pages 24–25 | page 649, right column | pages 868–870 |
| 6. Light Absorbers, Filter Dyes, and Ultraviolet Absorbers | pages 25–26 | page 649, right column to page 650, left column | page 873 |
| 7. Antistaining Agents | page 25, right column | page 650, left to right columns | page 872 |
| 8. Dye image Stabilizers | page 25 | page 650, left column | page 872 |
| 9. Hardening Agents | page 26 | page 651, left column | pages 874–875 |
| 10. Binders | page 26 | page 651, left column | pages 873–874 |
| 11. Plasticizers and Lubricants | page 27 | page 650, right column | page 876 |
| 12. Coating Aids and Surfactants | pages 26–27 | page 650, right column | pages 875–876 |
| 13. Antistatic Agents | page 27 | page 650, right column | pages 876–877 |
| 14. Matting Agents | — | — | pages 878–879 |

| | |
|---|---|
| 18. Formaldehyde Scavengers | lines 54 to 57, page 64 |
| 19. Mercapto-Based Antifoggants | lines 1 and 2, page 65 |
| 20. Releasing Agents of Antifoggants and the like | lines 3 to 7, page 65 |
| 21. Dyes | lines 7 to 10, page 65 |
| 22. Color Couplers in General | lines 11 to 13, page 65 |
| 23. Yellow, Magenta and Cyan Couplers | lines 14 to 25, page 65 |
| 24. Polymer Couplers | lines 26 to 28, page 65 |
| 25. Diffusible Dye-Forming Couplers | lines 29 to 31, page 65 |
| 26. Colored Couplers | lines 32 to 38, page 65 |
| 27. Functional Couplers in General | lines 39 to 44, page 65 |
| 28. Bleaching Accelerator-Releasing Couplers | lines 45 to 48, page 65 |
| 29. Development Accelerator-Releasing Couplers | lines 49 to 53, page 65 |
| 30. Other DIR Couplers | line 54, page 65 to line 4, page 66 |
| 31. Methods of Coupler Dispersion | lines 5 to 28, page 66 |
| 32. Preservatives, Antibacterial Agents | lines 29 to 33, page 66 |
| 33. Kinds of Photographic Materials | lines 34 to 36, page 66 |
| 34. Film Thickness of Light-Sensitive Layer and Film Swelling Rate | line 40, page 66 to line 1, page 67 |
| 35. Backing Layers | lines 3 to 8, page 67 |
| 36. Development Processing in General | lines 9 to 11, page 67 |
| 37. Developing Solutions and Developing Agents | lines 12 to 30, page 67 |
| 38. Additives for Developing Solution | lines 31 to 44, page 67 |
| 39. Reversal Process | lines 45 to 56, page 67 |
| 40. Open Factor of Processing Solutions | line 57, page 67 to line 12, page 68 |
| 41. Developing Time | lines 13 tb 15, page 68 |

-continued

| | |
|---|---|
| 42. Bleach-Fixing, Bleaching and Fixing | line 16, page 68 to line 31, page 69 |
| 43. Automatic Processors | lines 32 to 40, page 69 |
| 44. Washing, Rinsing and Stabilization | line 41, page 69 to line 18, page 70 |
| 45. Replenishment of Processing Solutions and Reuse | lines 19 to 23, page 70 |
| 46. Incorporation of Developing Agent in Photographic Material | lines 24 to 33, page 70 |
| 47. Temperature of Development Processing | lines 34 to 38, page 70 |
| 48. Use in Film Equipped with Lens | lines 39 to 41, page 70 |

The present invention will be illustrated in more detail with reference to examples below.

EXAMPLE 1

Emulsions A and B as comparative samples and Emulsions C to I of the present invention were prepared as follows.

Preparation of Emulsion A (comparative sample)

An aqueous solution (1.6 liters) containing 1.2 g of KBr and 1.2 g of low molecular weight gelatin having an average molecular weight of 15,000 was maintained at 35° C. and pBr at 2.3. To the aqueous solution, an aqueous solution of silver nitrate (containing 20.0 g of silver nitrate in 100 ml of the aqueous solution) and an aqueous solution of potassium bromide containing low molecular weight gelatin of concentration of 0.04 g/ml (containing 14.0 g of potassium bromide in 100 ml of the aqueous solution) were simultaneously added by a double jet method, with stirring, each in an amount of 60 ml at feed rate of 60 ml/min and the first nucleation was conducted. Immediately thereafter, 3.36 g of potassium bromide was added to the solution, the temperature was raised to 50° C. and ripening was carried out. About 35 minutes after the addition of silver nitrate, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were again added thereto for about 32 minutes with maintaining silver potential of 0 mV to a saturated calomel electrode. The feed rate of initial rate was 5 ml/min and was accelerated to reach final rate of 34 ml/min. The total amount of silver nitrate added in this example was 212 g. The carbon replica image of the thus-obtained emulsion grains was observed by TEM. Characteristics of the grains are as follows.

Proportion of tabular grains to the number of the entire grains (tabularity): 88%

Average diameter corresponding to sphere: 0.270 μm

Variation coefficient of diameter corresponding to sphere: 11%

Average thickness: 0.089 μm

Aspect ratio (diameter corresponding to circle/thickness): 4.4

Preparation of Emulsion B (comparative sample)

An aqueous solution (1.6 liters) containing 0.6 g of KBr and 0.8 g of low molecular weight gelatin having an average molecular weight of 15,000 was maintained at 35° C. and pBr at 2.8. To the aqueous solution, an aqueous solution of silver nitrate (containing 20.0 g of silver nitrate in 100 ml of the aqueous solution) and an aqueous solution of potassium bromide containing low molecular weight gelatin of concentration of 0.02 g/ml (containing 14.0 g of potassium bromide in 100 ml of the aqueous solution) were simultaneously added by a double jet method, with stirring, each in an amount of 60 ml at feed rate of 60 ml/min and the first nucleation was conducted. Immediately thereafter, 2.4 g of potassium bromide was added to the solution, the temperature was raised to 50° C. and ripening was carried out. About 53 minutes after the addition of silver nitrate, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were again added thereto for about 28 minutes with maintaining silver potential of −15 mV to a saturated calomel electrode. The feed rate of initial rate was 5 ml/min and was accelerated to reach final rate of 34 ml/min. The total amount of silver nitrate added in this example was 212 g. The carbon replica image of the thus-obtained emulsion grains was observed by TEM. Characteristics of the grains are as follows.

Proportion of tabular grains to the number of the entire grains: 86%

Average diameter corresponding to sphere: 0.250 μm

Variation coefficient of diameter corresponding to sphere: 13%

Average thickness: 0.080 μm

Aspect ratio: 4.8

Preparation of Emulsion C

One minute after the first nucleation of Emulsion A, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were further added to the solution in an amount of 93.8 ml, respectively, with maintaining silver potential of 0 mV (pBr =2.8) to a saturated calomel electrode. The feed rate of initial rate was 3 ml/min and was accelerated to reach final rate of 24 ml/min. Subsequently, 6.06 g of potassium bromide was added, temperature was raised to 40° C. and ripening was carried out. About 85 minutes after the addition of silver nitrate, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were again added thereto in the same manner as the preparation of Emulsion A. The total amount of silver nitrate added in this example was 212 g. The carbon replica image of the thus-obtained emulsion grains was observed by TEM. Characteristics of the grains of the present invention in the emulsion are as follows.

Proportion of tabular grains to the number of the entire grains: 80%

Average diameter corresponding to sphere: 0.250 μm

Variation coefficient of diameter corresponding to sphere: 12%

Average thickness: 0.087 μm

Aspect ratio: 4.0

Preparation of Emulsion D

One minute after the first nucleation of Emulsion A, 0.8 g of potassium bromide (pBr=2.4) was added thereto, then an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were further added to the solution in an amount of 93.8 ml, respectively, with maintaining silver potential of −20 mV (pBr=2.4) to a saturated calomel electrode. The feed rate of initial rate was 3 ml/min and was accelerated to reach final rate of 24 ml/min. Subsequently, 5.3 g of potassium bromide was added, temperature was raised to 40° C. and ripening was carried out. About 85 minutes after the addition of silver nitrate, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were again added thereto in the same manner as the preparation of Emulsion A. The total amount of silver nitrate added in this example was 212 g. The carbon replica image of the thus-obtained emulsion grains was observed by TEM. Characteristics of the grains of the present invention in the emulsion are as follows.

Proportion of tabular grains to the number of the entire grains: 85%

Average diameter corresponding to sphere: 0.254 μm

Variation coefficient of diameter corresponding to sphere: 13%

Average thickness: 0.089 μm

Aspect ratio: 4.0

Preparation of Emulsion E

One minute after the first nucleation of Emulsion A, 2.7 g of potassium bromide (pBr=2.1) was added thereto, then an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were further added to the solution in an amount of 93.8 ml, respectively, with maintaining silver potential of −40 mV (pBr=2.1) to a saturated calomel electrode. The feed rate of initial rate was 3 ml/min and was accelerated to reach final rate of 24 ml/min. Subsequently, 5.26 g of potassium bromide was added, temperature was raised to 40° C. and ripening was carried out. About 75 minutes after the addition of silver nitrate, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were again added thereto in the same manner as the preparation of Emulsion A. The total amount of silver nitrate added in this example was 212 g. The carbon replica image of the thus-obtained emulsion grains was observed by TEM. Characteristics of the grains of the present invention in the emulsion are as follows.

Proportion of tabular grains to the number of the entire grains: 86%

Average diameter corresponding to sphere: 0.217 μm

Variation coefficient of diameter corresponding to sphere: 18%

Average thickness: 0.081 μm

Aspect ratio: 3.9

Preparation of Emulsion F

One minute after the first nucleation of Emulsion A, 2.7 g of potassium bromide (pBr=2.1) was added thereto, then an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were further added to the solution in an amount of 46.9 ml, respectively, with maintaining silver potential of −40 mV (pBr=2.1) to a saturated calomel electrode. The feed rate of initial rate was 3 ml/min and was accelerated to reach final rate of 24 ml/min. Subsequently, 5.26 g of potassium bromide was added, temperature was raised to 40° C. and ripening was carried out. About 75 minutes after the addition of silver nitrate, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were again added thereto in the same manner as the preparation of Emulsion A. The total amount of silver nitrate added in this example was 212 g. The carbon replica image of the thus-obtained emulsion grains was observed by TEM. Characteristics of the grains of the present invention in the emulsion are as follows.

Proportion of the projected area of the grains of the present invention: 99%

Proportion of tabular grains to the number of the entire grains: 92%

Average diameter corresponding to sphere: 0.225 μm

Variation coefficient of diameter corresponding to sphere: 15%

Average thickness: 0.084 μm

Aspect ratio: 3.7

Preparation of Emulsion G

To Emulsion F, after ripening, an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were added for about 10 minutes with maintaining silver potential of 0 mV to a saturated calomel electrode. The feed rate of initial rate was 10 ml/min and was accelerated to reach final rate of 20 ml/min. Thereafter, potassium bromide was further added at initial feed rate of 30 ml/min while accelerating the feed rate to reach final rate of 40 ml/min for about 10 minutes with maintaining silver potential of −30 mV to a saturated calomel electrode. The total amount of silver nitrate added in this example was 212 g. The carbon replica image of the thus-obtained emulsion grains was observed by TEM. Characteristics of the grains of the present invention in the emulsion are as follows.

Proportion of tabular grains to the number of the entire grains: 93%

Average diameter corresponding to sphere: 0.228 μm

Variation coefficient of diameter corresponding to sphere: 13%

Average thickness: 0.070 μm

Aspect ratio: 5.0

Preparation of Emulsion H

One minute after the first nucleation of Emulsion B, 1.4 g of potassium bromide was added thereto, then an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were further added to the solution in an amount of 46.9 ml, respectively, with maintaining silver potential of −20 mV (pBr=2.4) to a saturated calomel electrode. The feed rate of initial rate was 3 ml/min and was accelerated to reach final rate of 24 ml/min. Subsequently, 1.0 g of potassium bromide was added, temperature was raised to 50° C. and ripening was carried out. At about 53 minutes after the addition of silver nitrate, grain growth was started in the same manner as Emulsion B. The total amount of silver nitrate added in this example was 212 g. The carbon replica image of the thus-obtained emulsion grains was observed by TEM. Characteristics of the grains of the present invention in the emulsion are as follows.

Proportion of tabular grains to the number of the entire grains: 89%

Average diameter corresponding to sphere: 0.230 μm

Variation coefficient of diameter corresponding to sphere: 15%

Average thickness: 0.080 μm

Aspect ratio: 4.4

Preparation of Emulsion I

One minute after the first nucleation of Emulsion B, 2.4 g of potassium bromide was added thereto, then an aqueous solution of silver nitrate (containing 32.0 g of silver nitrate in 100 ml of the aqueous solution) and an aqueous solution of potassium bromide (containing 22.4 g of potassium bromide in 100 ml of the aqueous solution) were further added to the solution in an amount of 46.9 ml, respectively, with maintaining silver potential of −40 mV (pBr=2.1) to a saturated calomel electrode. The feed rate of initial rate was 3 ml/min and was accelerated to reach final rate of 24 ml/min. Subsequently, temperature was raised to 50° C. and ripening was carried out. At about 53 minutes after the addition of silver nitrate, grain growth was started in the same manner as Emulsion B. The total amount of silver nitrate added in this example was 212 g. The carbon replica image of the thus-obtained emulsion grains was observed by TEM. Characteristics of the grains of the present invention in the emulsion are as follows.

Proportion of tabular grains to the number of the entire grains: 91%

Average diameter corresponding to sphere: 0.212 μm

Variation coefficient of diameter corresponding to sphere: 14%

Average thickness: 0.078 μm

Aspect ratio: 4.0

The results about the above Emulsions A to I are summarized in Tables 1 and 2.

Table 1: Effect of the Present Invention on Emulsion A pBr with respect to Emulsion A is pBr at the time of nucleation. pBr and the amount of silver nitrate with respect to each of Emulsions C, D, E, F and G are respectively pBr and the amount of silver nitrate at the time of adding a aqueous solution of silver salt or an aqueous solution of silver salt and an aqueous solution of halide after nucleation and before Ostwald ripening progresses.

TABLE 1

| Emulsion | pBr | Amount of Silver Nitrate (g) | Tabularity (%) | Diameter Corresponding to Sphere | Variation Coefficient (%) | Aspect Ratio |
|---|---|---|---|---|---|---|
| A | 2.4 | — | 88 | 0.270 | 11 | 4.4 |
| C | 2.8 | 30 | 80 | 0.250 | 12 | 4.0 |
| D | 2.4 | 30 | 85 | 0.254 | 13 | 4.0 |
| E | 2.1 | 30 | 86 | 0.217 | 18 | 3.9 |
| F | 2.1 | 15 | 92 | 0.225 | 15 | 3.7 |
| G | 2.1 | 15 | 93 | 0.228 | 13 | 5.0 |

Table 2: Effect of the Present Invention on Emulsion B pBr with respect to Emulsion B is pBr at the time of nucleation. pBr and the amount of silver nitrate with respect to each of Emulsions H and I are respectively pBr and the amount of silver nitrate at the time of adding an aqueous solution of silver salt or an aqueous solution of silver salt and an aqueous solution of halide after nucleation and before Ostwald ripening progresses.

TABLE 2

| Emulsion | pBr | Amount of Silver Nitrate (g) | Tabularity (%) | Diameter Corresponding to Sphere | Variation Coefficient (%) | Aspect Ratio |
|---|---|---|---|---|---|---|
| B | 2.8 | — | 86 | 0.250 | 13 | 4.8 |
| H | 2.4 | 15 | 89 | 0.230 | 15 | 4.4 |
| I | 2.1 | 15 | 91 | 0.212 | 14 | 4.0 |

As is apparent from the results in Table 1, Emulsion C of the present invention, to which were added an aqueous solution of silver salt and an aqueous solution of halide after the first nucleation before Ostwald ripening progressed, could reduce diameter corresponding to sphere of tabular grains compared with comparative Emulsion A. Further, from the comparison of Emulsions C, D and E of the present invention, it can be seen that further increase of tabularity and reduction of diameter corresponding to sphere of tabular grains can be obtained by the addition of the aqueous solution of silver salt under a lower pBr condition than a pBr value at the time of the first nucleation. It can also be understood from the comparison of Emulsions E and F of the present invention that tabularity and diameter corresponding to sphere can be controlled by the addition amount of the aqueous solution of silver salt.

From the comparison of comparative Emulsion B and Emulsions H and I of the present invention in Table 2, it can be seen that the effect of the present invention of the addition of an aqueous solution of silver salt and an aqueous solution of halide after the first nucleation before Ostwald ripening progresses can be obtained irrespective of changes of the pBr at the first nucleation and the concentration of gelatin.

Table 3: Proportion of Tabular Grain Number of Emulsions C, D, E, F and G to that of Comparative Emulsion A

TABLE 3

| Emulsion | Proportion of Tabular Grain Number |
|---|---|
| A | 1.0 |
| C | 1.3 |
| D | 1.2 |
| E | 1.9 |
| F | 1.7 |
| G | 1.7 |

Table 4: Proportion of Tabular Grain Number of Emulsions H and I to that of Comparative Emulsion B

TABLE 4

| Emulsion | Proportion of Tabular Grain Number |
|---|---|
| B | 1.0 |
| H | 1.3 |
| I | 1.6 |

Further, as is shown in Tables 3 and 4, it can be seen that the present invention can increase the number of tabular grains by the number of tabular grains calculated from the diameter corresponding to sphere.

EXAMPLE 2

Emulsion grains were grown according to the following method using comparative Emulsion B and Emulsion I of the present invention prepared in Example 1 as seed emulsions.

Formation of Core

An aqueous solution (1,200 ml) containing 0.0247 mol in terms of silver of comparative Emulsion B as seed emulsion, 1.9 g of KBr and 38 g of gelatin was maintained at 65° C. and stirred. After thiourea dioxide was added thereto, an aqueous solution of $AgNO_3$ (43.9 g) and an aqueous solution of KBr were added to the solution by a double jet method while accelerating the feed rate. At this time, silver potential was maintained at −20 mV to a saturated calomel electrode.

Formation of First Shell

After the above core grain was formed, an aqueous solution of $AgNO_3$ (43.9 g) and an aqueous solution of KBr containing KI in an amount of 28.0 mol % based on KBr were added to the reaction solution over 19 minutes by a double jet method while accelerating the feed rate. At this time, silver potential was maintained at −20 mV to a saturated calomel electrode.

Formation of Second Shell

After the above first shell was formed, an aqueous solution of $AgNO_3$ (42.6 g) and an aqueous solution of KBr were added to the reaction solution by a double jet method over 8 minutes while accelerating the feed rate. At this time, silver potential was maintained at +20 mV to a saturated calomel electrode.

Formation of Third Shell

After the above second shell was formed, benzenethiosulfinic acid was added, then an aqueous solution of KBr was added to adjust silver potential to −80 mV. 8.5 g in terms of $AgNO_3$ of silver iodide fine grain emulsion having average diameter corresponding to circle of 0.025 μm and variation coefficient of diameter corresponding to circle of 18% was abruptly added thereto within 5 seconds.

Formation of Fourth Shell

Thirty seconds after the addition of the above silver iodide fine grain emulsion, an aqueous solution of $AgNO_3$ (66.4 g) was added thereto over 4 minutes while reducing the feed rate. Hexa-chloronated iridium potassium was added en route. Silver potential after the addition was −10 mV. Ordinary washing was conducted and gelatin was added to adjust pH to 5.8 and pAg to 8.8 at 40° C. This emulsion was designated Emulsion P. Emulsion P was a tabular grain having average diameter corresponding to circle of 1.32 μm, variation coefficient of diameter corresponding to circle of 22%, average thickness of 0.180 μm, average aspect ratio of 7.3, and average diameter corresponding to sphere of 0.78 μm. Further, grains having aspect ratio of 6 or more accounted for about 90% of the entire projected area.

Emulsion Q was prepared in the same manner as the preparation of Emulsion P except that 0.0145 mol of Emulsion I of the present invention was used in place of comparative seed Emulsion B used in the formation of core in the preparation of Emulsion P.

Emulsion Q was a tabular grain having average diameter corresponding to circle of 1.33 μm, variation coefficient of diameter corresponding to circle of 14%, average thickness of 0.178 μm, average aspect ratio of 7.5, and average diameter corresponding to sphere of 0.78 μm. Further, grains having aspect ratio of 6 or more accounted for 90% or more of the entire projected area.

The temperature of Emulsions P and Q was raised to 56° C., thereto were added the following Sensitizing Dyes I, II, III, Compound I, potassium thiocyanate, chloroauric acid, sodium thiosulfate and N,N-dimethylselenourea and they were optimally sensitized.

Sensitizing Dye I

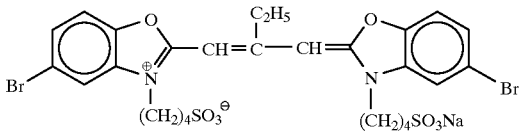

Sensitizing Dye II

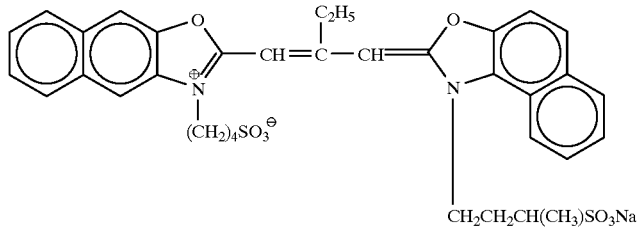

Sensitizing Dye III

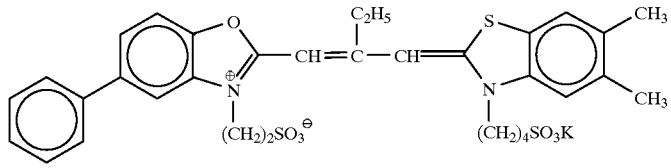

-continued

Compound I

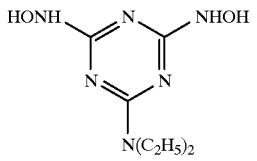

These Emulsions P and Q were each coated in the ninth layer of the following light-sensitive material and Sample Nos. 1 and 2 were obtained.

1) Support

The support used in this example was prepared according to the following manner.

100 weight parts of polyethylene-2,6-naphthalate polymer and 2 weight parts of Tinuvin P. 326 (product of Ciba Geigy AG), as an ultraviolet absorbing agent, were dried, then melted at 300° C., subsequently, extruded through a T-type die, and stretched 3.3 times in a machine direction at 140° C. and then 3.3 times in a transverse direction at 130° C., and further thermally fixed for 6 seconds at 250° C. and the PEN (polyethylene naphthalate) film having the thickness of 90 μm was obtained. Appropriate amounts of blue dyes, magenta dyes and yellow dyes were added to the PEN film (I-1, I-4, I-6, 1-24, I-26, I-27 and II-5 disclosed in JIII Journal of Technical Disclosure (Kokai-Giho), No. 94-6023). Further, the film was wound on to a stainless steel spool having a diameter of 20 cm and provided heat history at 110° C. for 48 hours to obtain a support reluctant to get curling habit.

2) Coating of Undercoat Layer

After both surfaces of the above support were subjected to corona discharge, UV discharge and glow discharge treatments, on one side of the support an undercoat solution having the following composition was coated (10 ml/$M^2$, using a bar coater): 0.1 g/$m^2$ of gelatin, 0.01 g/$m^2$ of sodium α-sulfo-di-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of polyamideepichlorohydrin polycondensation product. The undercoat layer was provided on the hotter side at the time of stretching. Drying was conducted at 115° C. for 6 minutes (the temperature of the roller and transporting device of the drying zone was 115° C.).

3) Coating of Backing Layer

On one side of the above support after undercoat layer coating, an antistatic layer, a magnetic recording layer and a sliding layer having the following compositions were coated as backing layers.

3-1) Coating of Antistatic Layer 0.2 g/$m^2$ of a dispersion of fine grain powder of a stannic oxide-antimony oxide composite having the average grain size of 0.005 μm and specific resistance of 5 Ω·cm (the grain size of the second agglomerate: about 0.08 μm), 0.05 g/$m^2$ of gelatin, 0.02 g/$m^2$ of $(CH_2{=}CHSO_2CH_2CH_2NHCO)_2CH_2$, 0.005 g/$m^2$ of polyoxyethylene-p-nonylphenol (polymerization degree: 10) and 0.22 g/$m^2$ of resorcin were coated.

3-2) Coating of Magnetic Recording Layer 0.06 g/$m^2$ of cobalt-γ-iron oxide which was coating-treated with 3-polyoxyethylene-propyloxytrimethoxysilane (polymerization degree: 15) (15 wt %) (specific surface area: 43 $m^2$/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide), 1.2 g/$m^2$ of diacetyl cellulose (dispersion of the iron oxide was carried out using an open kneader and a sand mill), 0.3 g/$m^2$ of $C_2H_5C[CH_2OCONH—C_6H_3(CH_3)NCO]_3$ as a curing agent, with acetone, methyl ethyl ketone and cyclohexanone as solvents, were coated with a bar coater to obtain a magnetic recording layer having the film thickness of 1.2 μm. As matting agents, silica grains (0.3 μm) and an aluminum oxide abrasive (0.15 μm) coating-treated with 3-polyoxyethylene-propyloxytrimethoxysilane (polymerization degree: 15) (15 wt %) were added each in an amount of 10 mg/$m^2$. Drying was conducted at 115° C. for 6 minutes (the temperature of the roller and transporting device of the drying zone was 115° C.). The increase of the color density of $D^B$ of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%.

3-3) Preparation of Sliding Layer

Diacetyl cellulose (25 mg/$m^2$), and a mixture of $C_6H_{13}CH(OH)C_{10}H_{20}COOC_{40}H_{81}$ (Compound a, 6 mg/$m^2$)/$C_{50}H_{101}O(CH_2CH_2O)_{16}H$ (Compound b, 9 mg/$m^2$) were coated. This mixture of Compound a/Compound b was dissolved in xylene/propylene monomethyl ether (1/1) by heating at 105° C., and poured into propylene monomethyl ether (10 time amount) at room temperature and dispersed, and further dispersed in acetone (average grain size: 0.01 μm), then added to the coating solution. Silica grains (0.3 μm), as a matting agent and aluminum oxide (0.15 μm) coated with 3-polyoxyethylene-propyloxytrimethoxysilane (polymerization degree: 15) (15 wt %), as an abrasive were added each in an amount of 15 mg/$m^2$. Drying was conducted at 115° C. for 6 minutes (the temperature of the roller and transporting device of the drying zone was 115° C.). The thus-obtained sliding layer showed excellent characteristic of dynamic friction coefficient of 0.06 (a stainless steel hard ball of 5 mmϕ, load: 100 g, speed: 6 cm/min), static friction coefficient of 0.07 (a clip method), and the sliding property with the surface of the emulsion described below provided dynamic friction coefficient of 0.12.

4) Coating of Light-sensitive Layer

Next, each layer having the following composition was multilayer coated on the opposite side of the above obtained backing layer and a color negative film was prepared as Sample No. 101.

Composition of Light-sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin (Specific compound in the following description is attached with numerical value and structural formula is cited later.)

The numeral corresponding to each component indicates the coated weight in unit of $g/m^2$, and the coated weight of silver halide is shown as the calculated weight of silver. Further, in the case of a sensitizing dye, the coated weight is indicated in unit of mol per mol of silver halide in the same layer.

| First Layer: Antihalation Layer | |
|---|---|
| Black Colloidal Silver | 0.09 as silver |
| Gelatin | 1.60 |
| ExM-1 | 0.12 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| **Second Layer: Interlayer** | |
| Silver Iodobromide Emulsion M | 0.065 as silver |
| ExC-2 | 0.04 |
| Polyethyl Acrylate Latex | 0.20 |
| Gelatin | 1.04 |
| **Third Layer: Low Sensitivity Red-Sensitive Emulsion Layer** | |
| Silver Iodobromide Emulsion A | 0.25 as silver |
| Silver Iodobromide Emulsion B | 0.25 as silver |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| **Fourth Layer: Middle Sensitivity Red-Sensitive Emulsion Layer** | |
| Silver Iodobromide Emulsion C | 0.70 as silver |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| **Fifth Layer: High Sensitivity Red-Sensitive Emulsion Layer** | |
| Silver Iodobromide Emulsion D | 1.40 as silver |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |

-continued

| Sixth Layer: Interlayer | |
|---|---|
| Cpd-1 | 0.090 |
| Solid Dispersion Dye ExF-4 | 0.030 |
| HBS-1 | 0.050 |
| Polyethyl Acrylate Latex | 0.15 |
| Gelatin | 1.10 |
| **Seventh Layer: Low Sensitivity Green-Sensitive Emulsion Layer** | |
| Silver Iodobromide Emulsion E | 0.15 as silver |
| Silver Iodobromide Emulsion F | 0.10 as silver |
| Silver Iodobromide Emulsion G | 0.10 as silver |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| **Eighth Layer: Middle Sensitivity Green-Sensitive Emulsion Layer** | |
| Silver Iodobromide Emulsion H | 0.80 as silver |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| **Ninth Layer: High Sensitivity Green-Sensitive Emulsion Layer** | |
| Emulsion P or Q | 1.25 as silver |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 |
| Gelatin | 1.33 |
| **Tenth Layer: Yellow Filter Layer** | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |
| Gelatin | 0.60 |
| **Eleventh Layer: Low Sensitivity Blue-Sensitive Emulsion Layer** | |
| Silver Iodobromide Emulsion J | 0.09 as silver |
| Silver Iodobromide Emulsion K | 0.09 as silver |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| **Twelfth Layer: High Sensitivity Blue-Sensitive Emulsion Layer** | |
| Silver Iodobromide Emulsion L | 1.00 as silver |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |

-continued

| | |
|---|---|
| HBS-1 | 0.070 |
| Gelatin | 0.70 |
| Thirteenth Layer: First Protective Layer | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| Fourteenth Layer: Second Protective Layer | |
| Silver Iodobromide Emulsion M | 0.10 as silver |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, W-1 to W-3, B-4 to B-6, F-1 to F-17, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

Preparation of Solid Dispersion Dye

ExF-2 used in the above photographic material was dispersed according to the following method. That is, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The BO type vibrating ball mill manufactured by Chuo Koki was used for the dispersion. The content was taken out after dispersion and added to 8 g of a 12.5% aqueous solution of gelatin and the beads were removed by filtration and the gelatin dispersion of the dye was obtained. The average grain size of fine grains of the dye was 0.44 μm.

Solid dispersions of ExF-3, ExF-4 and ExF-6 were obtained in the same manner. The average grain sizes of fine grains of the dyes were 0.24 μm, 0.45 μm and 0.52 μm, respectively. ExF-5 was dispersed according to the micro-precipitation dispersion method disclosed in Working Example 1 of EP-A-549489. The average grain size was 0.06 μm.

Compounds used in the preparation of the above layers are shown below.

ExC-1

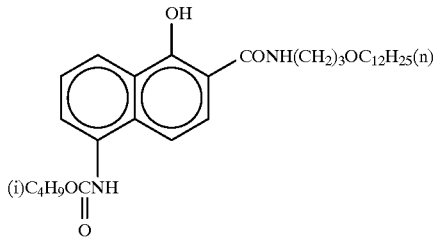

ExC-2

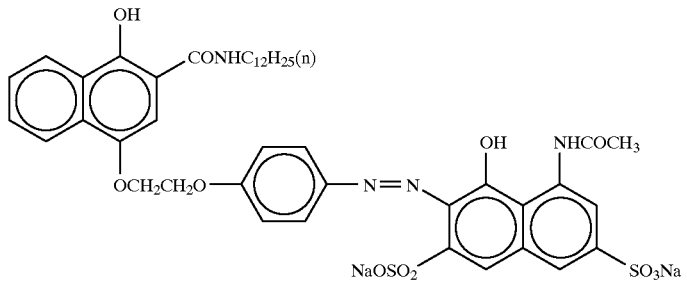

ExC-3

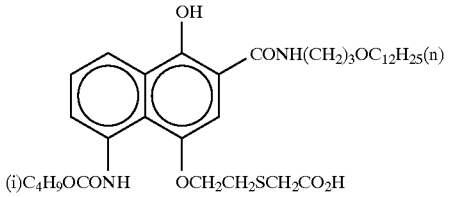

-continued
ExC-4
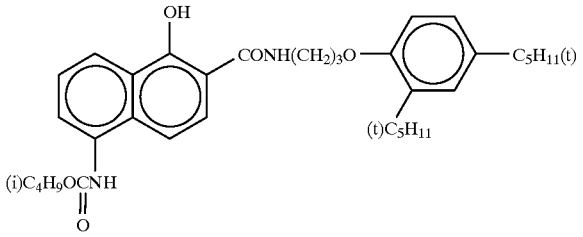
ExC-5
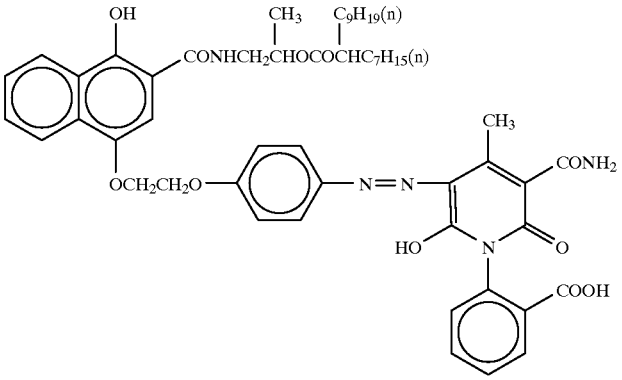
ExC-6
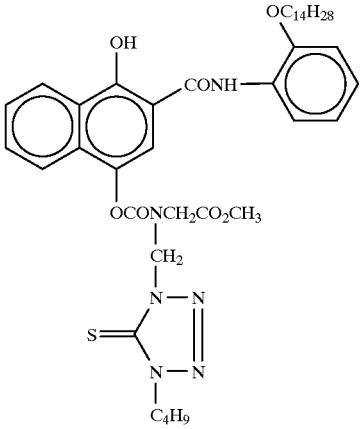
ExC-7
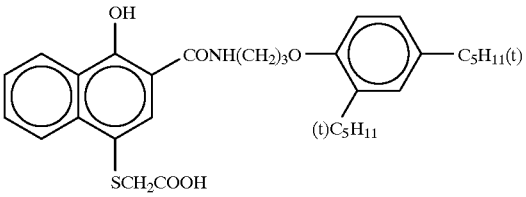

-continued
ExC-8
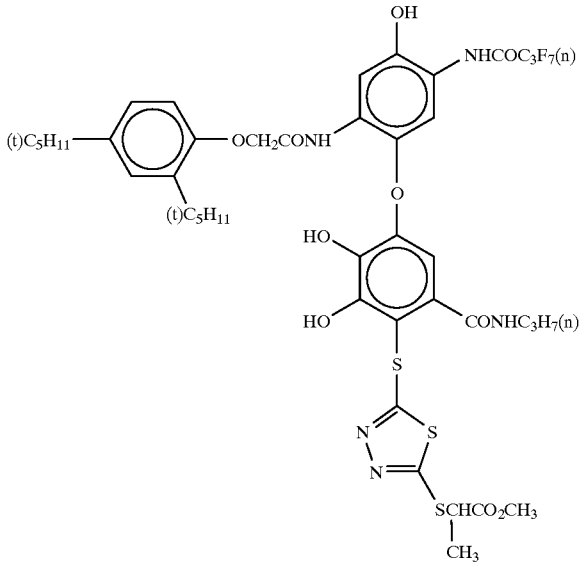
ExM-1
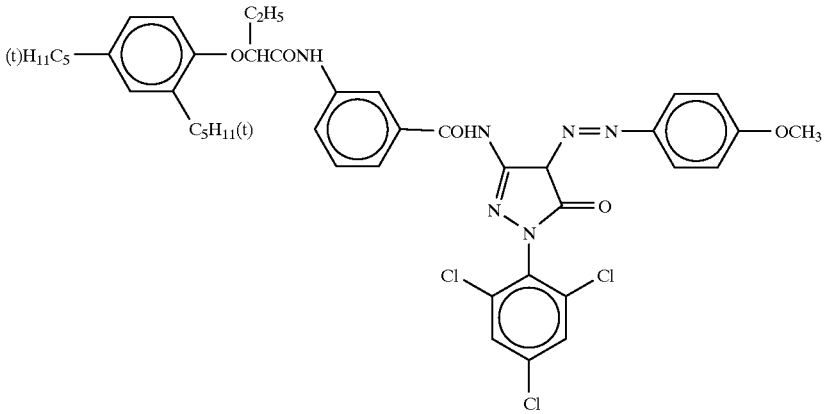
ExM-2
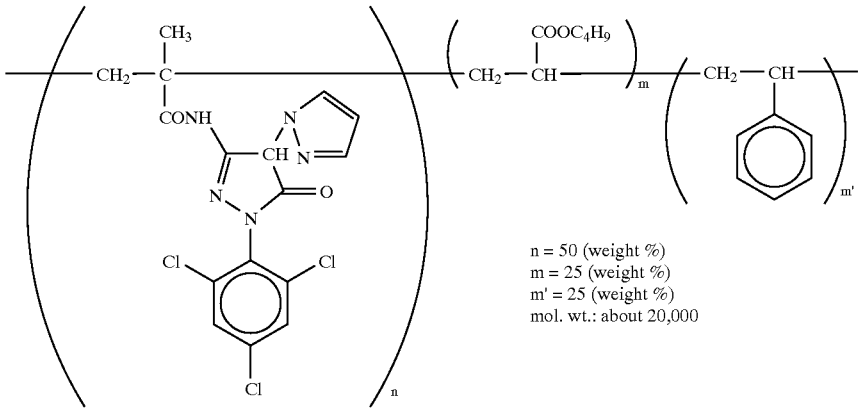

-continued
ExM-3
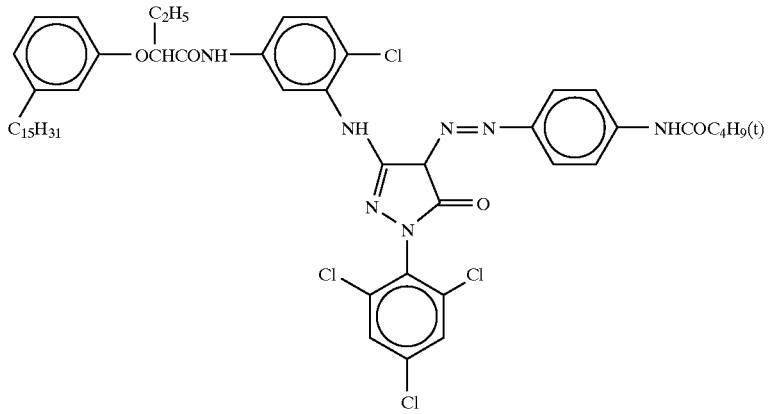
ExM-4
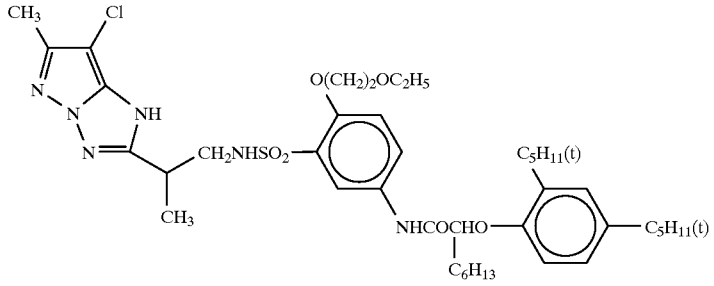
ExM-5
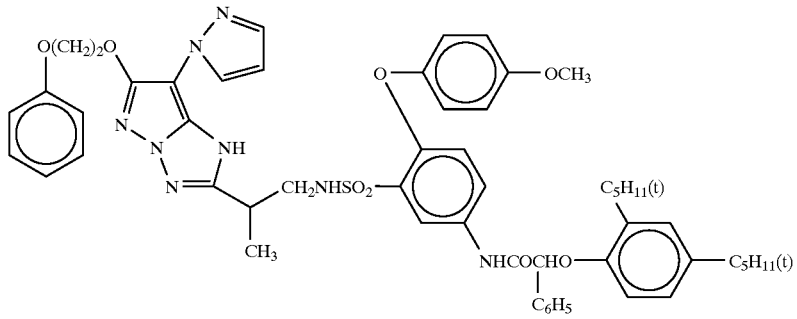
ExY-1
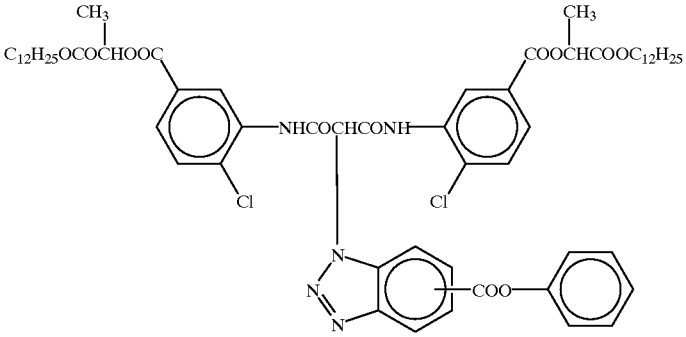

-continued
ExY-2
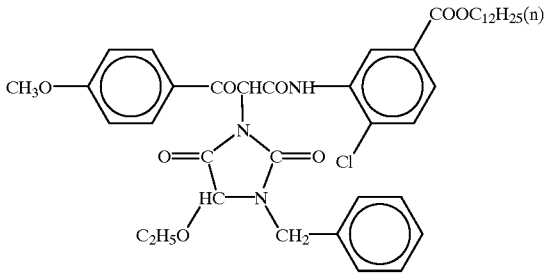
ExY-3
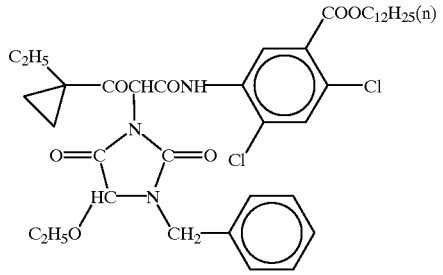
ExY-4
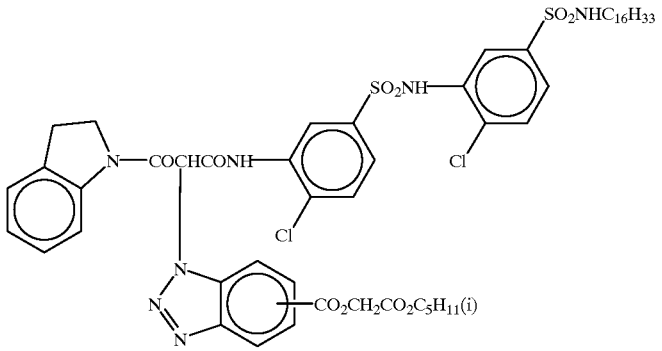
ExY-5
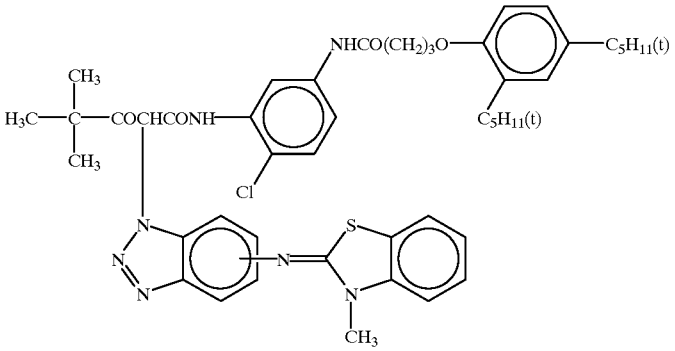
ExF-1
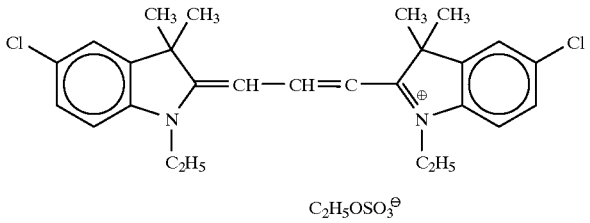

-continued
ExF-2
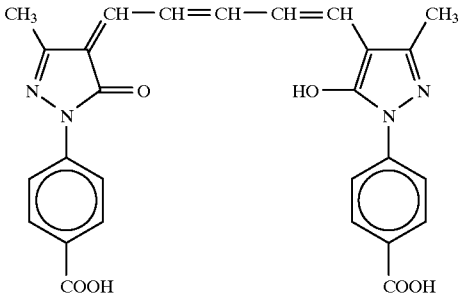
ExF-3
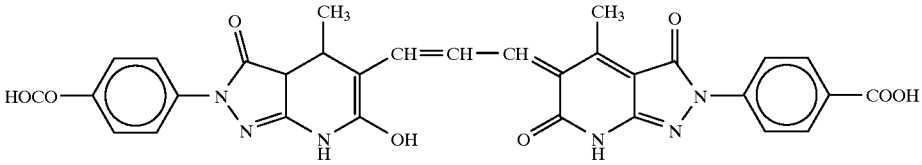
ExF-4
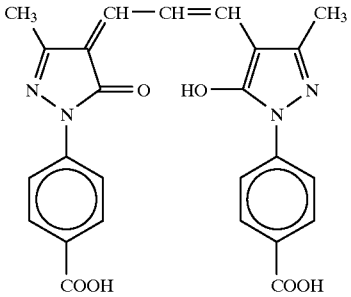
ExF-5
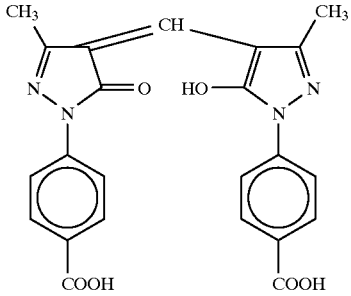
ExF-6
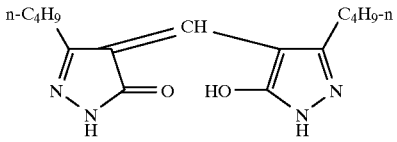
ExF-7
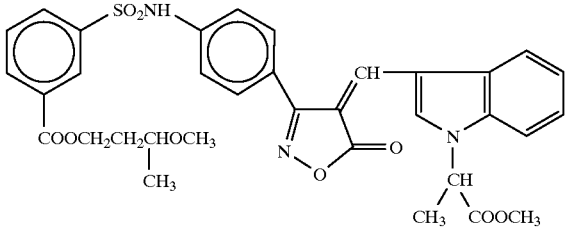

-continued
Cpd-1
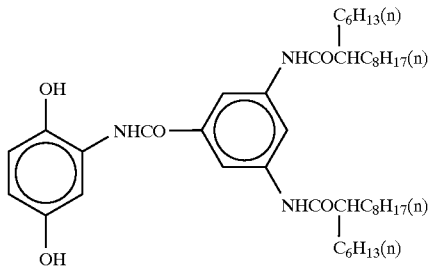
Cpd-2
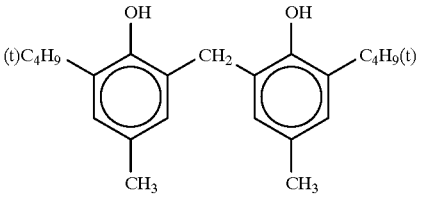
Cpd-3
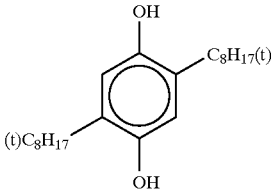
UV-1
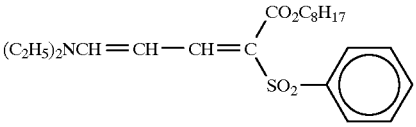
UV-2
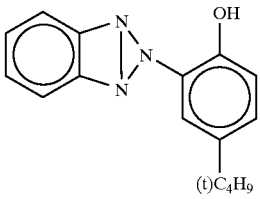
UV-3
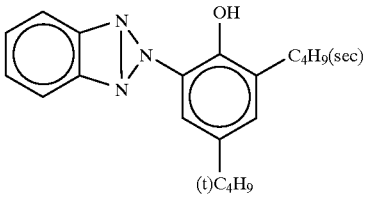
HBS-1
Tricresyl Phosphate
HBS-2
Di-n-butyl Phthalate
HBS-3
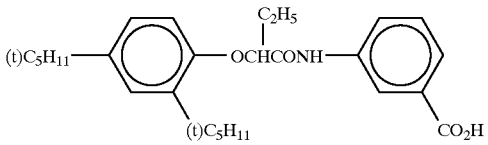

-continued
HBS-4
Tri(2-ethylhexyl) Phosphate
ExS-1
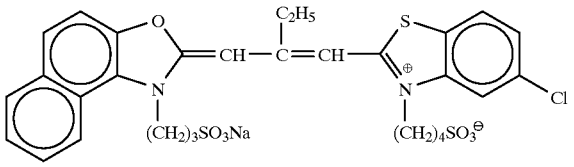
ExS-2
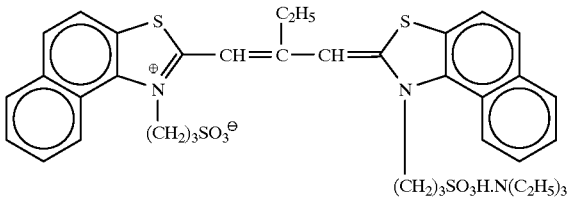
ExS-3
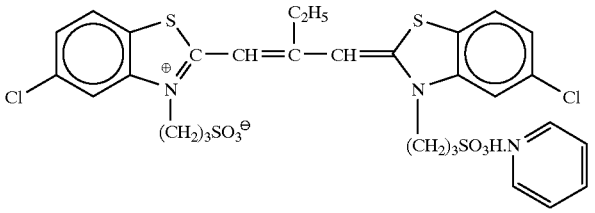
ExS-4
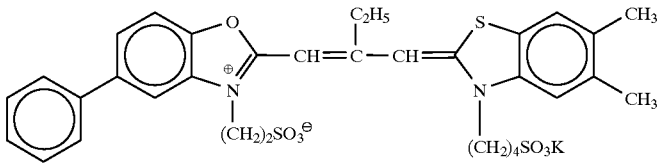
ExS-5
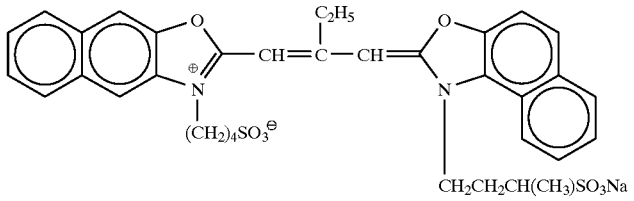
ExS-6
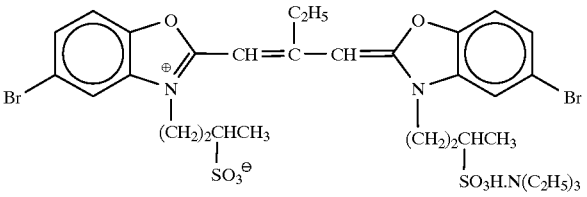

-continued
ExS-7
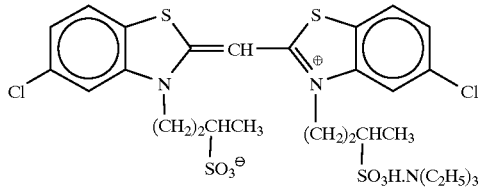
S-1
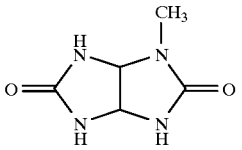
H-1
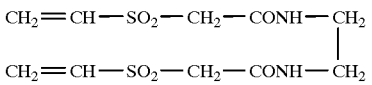
B-1
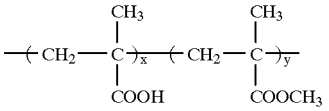
x/y = 10/90 (weight ratio)
average molecular weight:
about 35,000
B-2
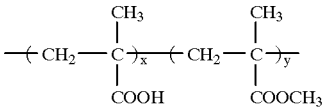
x/y = 40/60 (weight ratio)
average molecular weight:
about 20,000
B-3
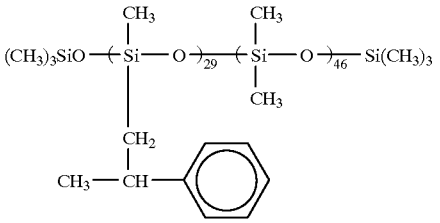
(mol ratio)
average molecular weight:
about 8,000

-continued
B-4
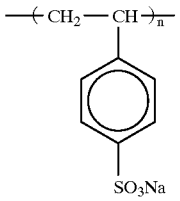
average molecular weight:
about 750,000
(n = an integer)
B-5
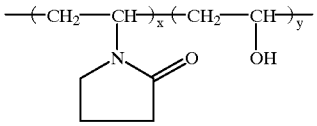
x/y = 70/30 (weight ratio)
average molecular weight:
about 17,000
B-6
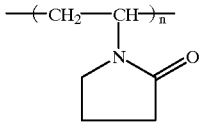
average molecular weight:
about 10,000
(n = an integer)
W-1
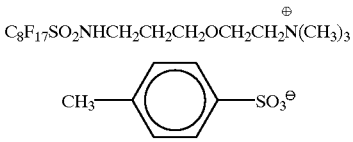
W-2
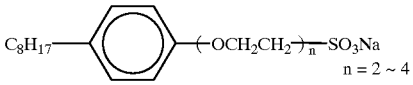
W-3
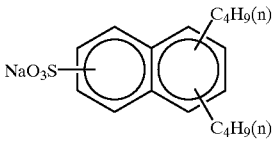
F-1
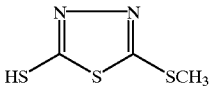

-continued
F-2
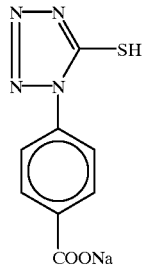
F-3
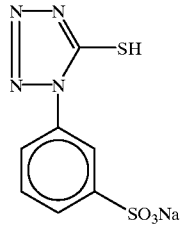
F-4
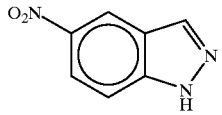
F-5
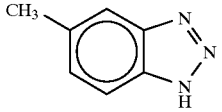
F-6
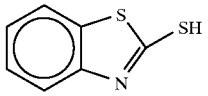
F-7
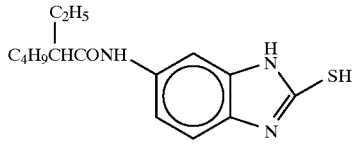
F-8
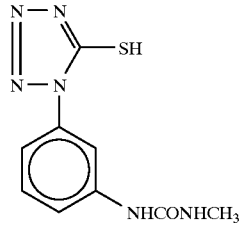
F-9
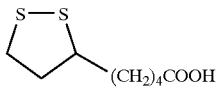

-continued

F-10

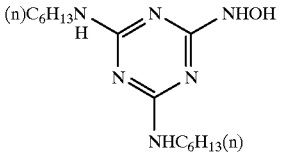

F-11

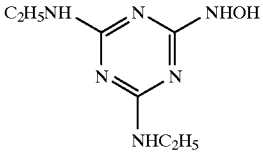

F-12

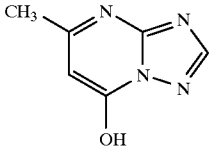

F-13

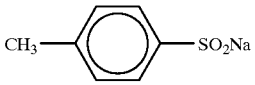

F-14

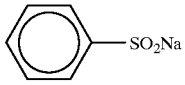

F-15

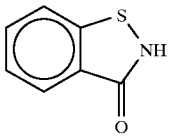

F-16

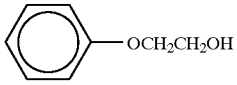

F-17

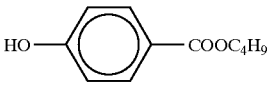

Average AgI content and grain size of each of Emulsions A to H and J to M used in Sample Nos. 1 and 2 are shown in Table 5 below.

TABLE 5

| Emulsion | Characteristic Value of Emulsion: Diameter Corresponding to Circle (μm) | Thickness (μm) | Average AgI Content (%) |
|---|---|---|---|
| A | 0.28 | 0.07 | 3.1 |
| B | 0.70 | 0.10 | 3.1 |

TABLE 5-continued

| Emulsion | Characteristic Value of Emulsion: Diameter Corresponding to Circle (μm) | Thickness (μm) | Average AgI Content (%) |
|---|---|---|---|
| C | 1.02 | 0.17 | 5.4 |
| D | 1.26 | 0.18 | 5.4 |
| E | 0.28 | 0.07 | 3.1 |

TABLE 5-continued

| Characteristic Value of Emulsion | | | |
|---|---|---|---|
| Emulsion | Diameter Corresponding to Circle (μm) | Thickness (μm) | Average AgI Content (%) |
| F | 0.49 | 0.07 | 3.1 |
| G | 0.70 | 0.10 | 3.1 |
| H | 1.02 | 0.17 | 5.4 |
| J | 0.42 | 0.07 | 3.1 |
| K | 0.70 | 0.10 | 5.3 |
| L | 1.33 | 0.19 | 7.0 |
| M | 0.07 | 0.07 | 1.0 |

Emulsions J, K and L were reduction sensitized during preparation of the grains using thiourea dioxide and thiosulfonic acid according to the examples of JP-A-2-191938 (corresponding to U.S. Pat. No. 5,061,614).

Emulsions A to H and J to L were gold, sulfur, and selenium sensitized, respectively, in the presence of the spectral sensitizing dyes which are described at each light-sensitive layer and sodium thiocyanate according to the examples of JP-A-3-237450 (corresponding to EP-A-443453).

Low molecular weight gelatin was used in the preparation of the tabular grains according to the examples of JP-A-1-158426, and there were observed such dislocation lines as disclosed in JP-A-3-237450 (corresponding to EP-A-443453) using a high pressure electron microscope.

Each of the thus-prepared photographic material Sample Nos. 1 and 2 was exposed by white light for 1/100 seconds through continuous wedge and processed as follows.

Samples were processed according to the following step using Nega Processor FP-350 manufactured by Fuji Photo Film Co., Ltd. until the accumulated replenishment amount of the processing solution reached 3 time of the capacity of the mother liquid tank.

| Processing Step | | | |
|---|---|---|---|
| Step | Processing Time | Processing Temperature (° C.) | Replenishment* Amount (ml) |
| Color Development | 3 min 15 sec | 38 | 45 |
| Bleaching | 1 min 00 sec | 38 | 20 The overflow from the bleaching tank was all introduced into the bleach-fixing tank. |
| Bleach-Fixing | 3 min 15 sec | 38 | 30 |
| Washing (1) | 40 sec | 35 | countercurrent system from (2) to (1) |
| Washing (2) | 1 min 00 sec | 35 | 30 |
| Stabilization | 40 sec | 38 | 20 |
| Drying | 1 min 15 sec | 55 | |

*Replenishment rate: per 1.1 meter of 35 mm wide photographic material (corresponding to a 24 ex. film)

The composition of each processing solution is described below.

| Color Developing Solution | | |
|---|---|---|
| | Tank Solution (g) | Replenisher (g) |
| Diethylenetriaminepentaacetic Acid | 1.0 | 1.1 |
| 1-Hydroxyethylidene-1,1-diphosphonic Acid | 2.0 | 2.0 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-Ethyl-N-(β-hydroxyethyl)-amino]-2-methylaniline Sulfate | 4.5 | 5.5 |
| Water to make | 1.0 l | 1.0 l |
| pH (adjusted with potassium hydroxide and sulfuric acid) | 10.05 | 10.10 |

| Bleaching Solution | |
|---|---|
| | Replenisher equals tank solution (unit: g) |
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerator $(CH_3)_2N—CH_2—CH_2—S—S—CH_2—CH_2—N(CH_3)_2.2HCl$ | 0.005 ml |
| Aqueous Ammonia (27%) | 15.0 ml |
| Water to make | 1.0 l |
| pH (adjusted with aqueous ammonia and nitric acid) | 6.3 |

| Bleach-Fixing Solution | | |
|---|---|---|
| | Tank Solution (g) | Replenisher (g) |
| Ammonium Ethylenediaminetetra-acetato Ferrate Dihydrate | 50.0 | — |
| Disodium Ethylenediaminetetra-acetate | 5.0 | 2.0 |
| Sodium Sulfite | 12.0 | 20.0 |
| Aqueous Solution of Ammonium Thiosulfate (700 g/liter) | 240.0 ml | 400.0 ml |
| Aqueous Ammonia (27%) | 6.0 ml | — |
| Water to make | 1.0 l | 1.0 l |
| pH (adjusted with aqueous ammonia and acetic acid) | 7.2 | 7.3 |

Washing Water (replenisher equals tank solution)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

| Stabilizing Solution (replenisher equals tank solution) | |
|---|---|
| | (unit: g) |
| Sodium p-Toluenesulfinate | 0.03 |
| Polyoxyethylene-p-monononylphenyl Ether (average polymerization degree: | 0.2 |

-continued

| Stabilizing Solution (replenisher equals tank solution) | (unit: g) |
|---|---|
| 10) | |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

Magenta density obtained was measured, and fog and sensitivity at fog +0.1 optical density was found out. The obtained are shown in Table 6.

TABLE 6

| Sample No. | Emulsion | Fog | Sensitivity |
|---|---|---|---|
| 1 | P (Comparison) | 0.20 | 166 |
| 2 | Q (Invention) | 0.19 | 174 |

From the results in Table 6, it can be seen that sensitivity/fog ratio is improved by the emulsion of the present invention.

While the invention has been described in detail and with reference to specific examples thereof, it will be apparent to one skilled in the art that various changes and modifications can be made therein without departing from the spirit and scope thereof.

What is claimed is:

1. A method for producing a silver halide photographic emulsion comprising tabular grains of silver bromide or silver iodobromide having {111} faces as major faces parallel to each other, comprising, (a) performing a first nucleation;

(b) adding, before Ostwald ripening, an aqueous solution of silver salt or an aqueous solution of silver salt and an aqueous solution of halide at a feed rate of 0.0003 to 0.02 mol/min per liter of total contents, wherein step (b) is carried out at a pBr of 2.5 or less; and (c) allowing Ostwald ripening to progress, wherein said step (b) of adding occurs at least one time between steps (a) and (c) and wherein the time from the first nucleation step (a) until the addition step (b) is from 0 to 5 minutes.

2. The method for producing a silver halide photographic emulsion as claimed in claim 1, wherein the pBr at the time of the addition of said aqueous solution of silver salt or said aqueous solution of silver salt and said aqueous solution of halide is different from the pBr at the time of the first nucleation.

3. The method for producing a silver halide photographic emulsion as claimed in claim 2, wherein the pBr at the time of the addition of said aqueous solution of silver salt or said aqueous solution of silver salt and said aqueous solution of halide is lower than the pBr at the time of the first nucleation.

4. The method for producing a silver halide photographic emulsion as claimed in claim 3, wherein the nucleus is grown by the addition of said aqueous solution of silver salt or said aqueous solution of silver salt and said aqueous solution of halide.

5. The method for producing a silver halide photographic emulsion as claimed in claim 2, wherein the nucleus is grown by the addition of said aqueous solution of silver salt or said aqueous solution of silver salt and said aqueous solution of halide.

6. The method for producing a silver halide photographic emulsion as claimed in claim 1, wherein the nucleus is grown by the addition of said aqueous solution of silver salt or said aqueous solution of silver salt and said aqueous solution of halide.

7. The method for producing a silver halide photographic emulsion as claimed in claim 1, wherein the time from the first nucleation step (a) until the addition step (b) is the time in which the average grain size of the silver halide grains does not change by 50% or more.

8. The method for producing a silver halide photographic emulsion as claimed in claim 7, wherein the time from the first nucleation step (a) until the addition step (b) is the time in which the average grain size of the silver halide grains does not change by 20% or more.

9. The method for producing a silver halide photographic emulsion as claimed in claim 8, wherein the time from the first nucleation step (a) until the addition step (b) is the time in which the average grain size of the silver halide grains does not change by 10% or more.

10. The method for producing a silver halide photographic emulsion as claimed in claim 1, wherein the time from the first nucleation step (a) until the addition step (b) is from 0 to 2 minutes.

11. The method for producing a silver halide photographic emulsion as claimed in claim 10, wherein the time from the first nucleation step (a) until the addition step (b) is from 0 to 1 minute.

12. The method for producing a silver halide photographic emulsion as claimed in claim 1, wherein the addition time of the first nucleation step (a) is from 10 seconds to 5 minutes.

13. The method for producing a silver halide photographic emulsion as claimed in claim 12, wherein the addition time of the first nucleation step (a) is from 10 seconds to 3 minutes.

14. The method for producing a silver halide photographic emulsion as claimed in claim 13, wherein the addition time of the first nucleation step (a) is from 15 seconds to 1.5 minutes.

15. The method for producing a silver halide photographic emulsion according to claim 1, wherein the feed rate in step (b) is from 0.01 to 0.2 mol/min per liter of total contents.

16. A method for producing a silver halide photographic emulsion comprising tabular grains of silver bromide or silver iodobromide having {111} faces as major faces parallel to each other, comprising, (a) performing a first nucleation;

(b) adding, before Ostwald ripening, an aqueous solution of silver salt or an aqueous solution of silver salt and an aqueous solution of halide at a feed rate of 0.0003 to 0.02 mol/min per liter of total contents, wherein step (b) is carried out at a pBr value of 2.5 or less; and (c) allowing Ostwald ripening to progress, wherein said step b) of adding occurs at least one time between steps (a) and (c), wherein the time from the first nucleation step (a) until the addition step (b) is from 0 to 5 minutes, and wherein step (b) results in tabular nuclei growing faster than non-tabular nuclei such that the non-tabular nuclei dissolve whereas the tabular nuclei do not dissolve.

* * * * *